US007721908B2

(12) United States Patent
Cronin et al.

(10) Patent No.: US 7,721,908 B2
(45) Date of Patent: May 25, 2010

(54) CONTAINER HAVING A SLIDEABLE COVER

(75) Inventors: Edward P. Cronin, Brodhead, WI (US); Paul Schneider, Rockford, IL (US); George Solewiejko, Rockford, IL (US); Joseph O'Connell, Hershey, PA (US)

(73) Assignees: J.L. Clark, Inc., Rockford, IL (US); The Hershey Company, Hershey, PA (US)

( * ) Notice: Subject to any disclaimer, the term of this patent is extended or adjusted under 35 U.S.C. 154(b) by 965 days.

(21) Appl. No.: 11/324,636

(22) Filed: Jan. 3, 2006

(65) Prior Publication Data

US 2007/0164032 A1 Jul. 19, 2007

(51) Int. Cl.
*B65D 43/12* (2006.01)
*B65D 43/20* (2006.01)

(52) U.S. Cl. ..... 220/345.4; 220/345.1; 220/351

(58) Field of Classification Search ... 220/345.1–345.4, 220/351, 254.9, 354.2, 350; 206/1.5, 528, 206/555

See application file for complete search history.

(56) References Cited

U.S. PATENT DOCUMENTS 2,708,026 A * 5/1955 Duell ..... 206/539
3,362,564 A * 1/1968 Mueller ..... 220/345.3
3,401,993 A * 9/1968 Fenkel ..... 312/111
3,527,373 A * 9/1970 Giraudet et al. ..... 220/345.1
3,942,630 A * 3/1976 Phillips ..... 206/1.5
4,284,204 A * 8/1981 Carey, Jr. ..... 220/345.3
D367,211 S 2/1996 Cautereels
D393,063 S 3/1998 Wefler
D407,972 S 4/1999 Hilton
5,950,816 A * 9/1999 Reid ..... 206/38.1
D432,911 S 10/2000 Clarke et al.
D433,940 S 11/2000 Lindsay et al.
6,210,638 B1 * 4/2001 Grieco et al. ..... 422/22
6,341,710 B1 1/2002 Danielson et al.
D465,729 S 11/2002 Nishimura
D478,280 S 8/2003 Miller et al.
D479,462 S 9/2003 Chan
D505,089 S 5/2005 Thadani
D527,995 S 9/2006 Tanner
D527,996 S 9/2006 Tanner
D531,023 S 10/2006 Tanner
D534,068 S 12/2006 Tanner
D534,070 S 12/2006 Tanner (Continued)

*Primary Examiner*—Anthony Stashick
*Assistant Examiner*—Madison L Wright
(74) *Attorney, Agent, or Firm*—Reinhart Boerner Van Deuren P.C.

(57) ABSTRACT

A container comprising a plastic container base, a plastic container lid, and a pair of first and second tracks is provided. The container base has a bottom, front and back ends, and a pair of sidewalls that define a storage area. The container lid is slideably disposed on the plastic container base and includes a cover portion that encloses the storage area when the plastic container is in a closed position. The pair of first tracks are included one on each of the sidewalls. The pair of second tracks depend downwardly from opposing sides of the cover portion and slideably engage the pair of first tracks. As such, the container lid is slideable from the closed position to an open position to form a dispensing opening between the front end of the container base and a forward edge of the cover portion.

29 Claims, 20 Drawing Sheets

U.S. PATENT DOCUMENTS

D535,184 S 1/2007 Tanner
D535,185 S 1/2007 Tanner
2004/0055903 A1* 3/2004 Nishimura ..... 206/1.5
2004/0188317 A1* 9/2004 Krumme ..... 206/557
2004/0217116 A1* 11/2004 Offerman et al. ..... 220/345.2
2009/0065390 A1* 3/2009 Oono et al. ..... 206/555

* cited by examiner

CONTAINER HAVING A SLIDEABLE COVER

FIELD OF THE INVENTION

This invention generally relates to hand-held containers and, more particularly, to hand-held containers having a discretely and slideably positionable cover.

BACKGROUND OF THE INVENTION

Handheld containers are typically used for storing consumable and non-consumable items such as, for example, pills, candies, and the like. There are many different varieties and types of handheld containers. While many have been satisfactory for one purpose or another, there is always a desire for further options, features, and improvements in the art to which the present invention is directed.

BRIEF SUMMARY OF THE INVENTION

One aspect of the present invention is directed toward a practical container with mating tracks between a plastic container base and sides of a plastic container lid. The container includes a plastic container base, a plastic container lid, a pair of first tracks, and a pair of second tracks. The plastic container base has a bottom, front and back ends extending upwardly from the bottom in spaced relation, and a pair of sidewalls extending upwardly from the bottom and transversely between the front and back ends to define a storage area. The plastic container lid is slideably disposed on the plastic container base and includes a cover portion that encloses the storage area when the plastic container is in a closed position. One of the pair of first tracks are included on each of the sidewalls. The pair of second tracks depend downwardly from opposing sides of the cover portion. The pair of second tracks also slideably engage the pair of first tracks such that the plastic container lid is slideable from the closed position to an open position to form a dispensing opening between the front end of the plastic container base and a forward edge of the cover portion.

Another aspect of the present invention is directed toward a practical container with a plastic container lid that slides between defined, discrete positions. The container provides container comprising a plastic container base, a plastic container lid, and a stop mechanism. The plastic container base has a bottom, front and back ends extending upwardly from the bottom in spaced relation, and a pair of sidewalls extending upwardly from the bottom and transversely between the front and back ends to define a storage area. The plastic container lid is slideably disposed on the plastic container base and movable between closed and open positions. The plastic container lid also includes a cover portion that encloses the storage area in the closed position. The plastic container lid further forms a dispensing opening when slid from the closed position to the open position. The stop mechanism comprises cooperating components respectively arranged on the plastic container base and the plastic container lid. The cooperating components includes a plurality of detents and a resilient catch. The resilient catch engages the detents to define different discrete positions of the closed and open positions between the container lid and the container base.

Another aspect of the present invention is directed toward a container with a slide mechanism and a stopping means combination. The container comprises a plastic container base, a plastic container lid, and means for stopping the container lid. The plastic container base has a bottom, front and back ends extending upwardly from the bottom in spaced relation, and a pair of sidewalls extending upwardly from the bottom and transversely between the front and back ends to define a storage area. The plastic container lid is slideably disposed on the plastic container base and movable between closed and open positions. The plastic container lid also includes a cover portion that encloses the storage area in the closed position. The plastic container lid is further movable from the closed position to provide a dispensing opening. The means for stopping the container lid stops the container lid in the closed position and in at least one open position displaced a predetermined distance from the closed position to define a dispensing opening of a predetermined size.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
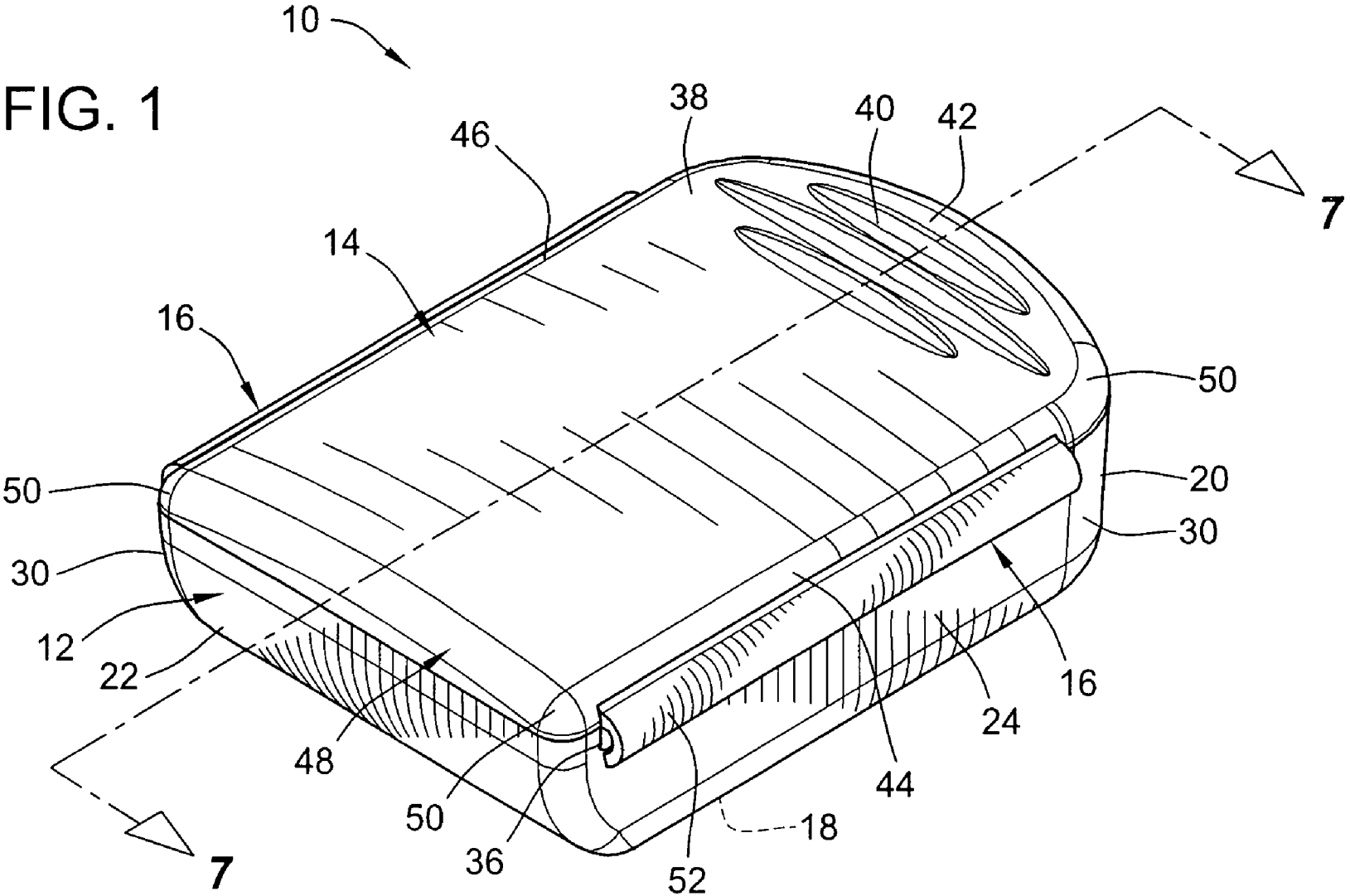
FIG. 1 is a top and back perspective view of an exemplary embodiment of a container as constructed in accordance with the teachings of the present invention.

Referring to FIG. 1, a container 10 is illustrated. As will be explained more fully below, the container 10 is preferably dimensioned and designed to be compatible with a hand and, more specifically, the palm of a hand although other non-handheld uses may be provided for larger containers. For handheld applications, the container measured front to back preferably has a length of between about one and a half inches to about four and a half inches, a width measured side to side of between about one inch to about three four, and a depth measured top to bottom of between about half an inch to about one and a half inches (all measurements taken when the container is closed and at the longest span). The container 10 is uncomplicated to open and close and, preferably, can be can manipulated between closed and open positions (and back again) using a finger and/or thumb. Further, the container 10 repeatedly alternatively dispenses and stores a product therein. As shown in FIG. 1, the container 10 comprises a plastic container base 12, a plastic container lid 14, and a slide engagement system 16 therebetween. Preferably, the container 10 comprises only two unitary molded plastic components as shown, including the base 12 and the lid 14, which integrally provide the sliding and retention system and discrete stopping system.

Figure 2:
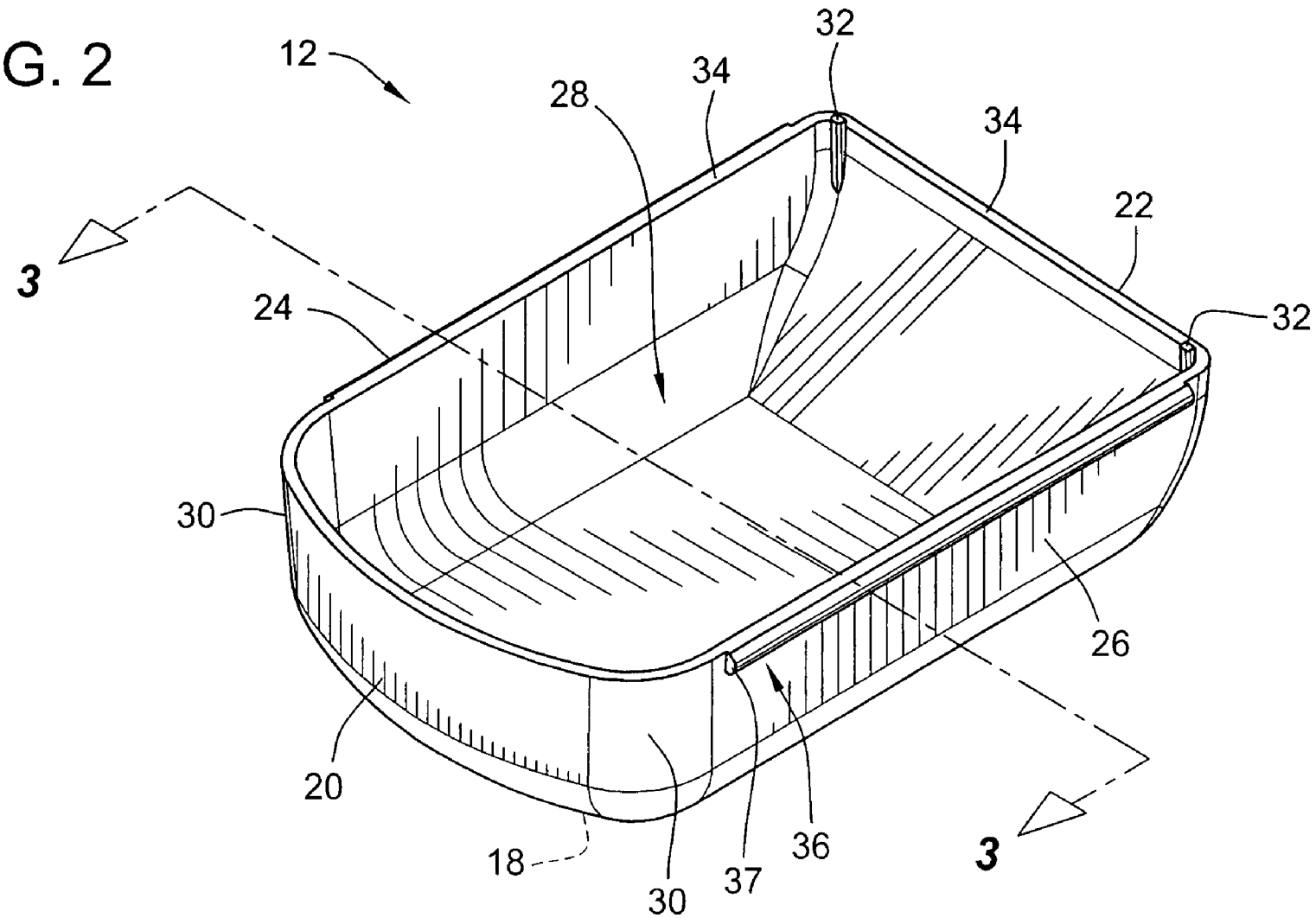
FIG. 2 is a top and front perspective view of a plastic container base from the container of FIG. 1 highlighting a pair of first tracks and an upwardly protruding catch.

The plastic container base 12, as illustrated in FIG. 2, has a bottom 18, front and back ends 20, 22 extending upwardly from the bottom in spaced relation, and a pair of sidewalls 24, 26 extending upwardly from the bottom and transversely between the front and back ends to define a storage area 28. The bottom 18 and the side walls 24, 26 are generally planar and/or flat. Each of the front and back ends 20, 22 and the pair of side walls 24, 26 can be rounded or radiused near or proximate the bottom 18. Likewise, each of the front and back ends 20, 22 can be rounded and/or sloped. Moreover, corners 30 of the plastic container base 12, formed by the generally vertical intersection of the front and back ends 20, 22 and the pair of side walls 24, 26, can also be rounded or radiused. By smoothing these corners and edges, the container 10 is more comfortably held in the palm of a hand.

Still referring to FIG. 2, the plastic container base 12 further includes one or more catches 32. These catches 32 are formed from a resilient material such as, for example, plastic. In a preferred embodiment, each catch 32 is integrally formed and molded with the plastic container base 12. The catches 32 are disposed upon the plastic container base 12 proximate an intersection of the sidewalls 24, 26 and the back end 22. In the disclosed embodiment, the catches 32 are depicted in the form of a tab or prong that generally extends upwardly (away from the bottom 18) and, preferably, protrude above a peripheral surface 34 of the plastic container base 12.

Figure 3:
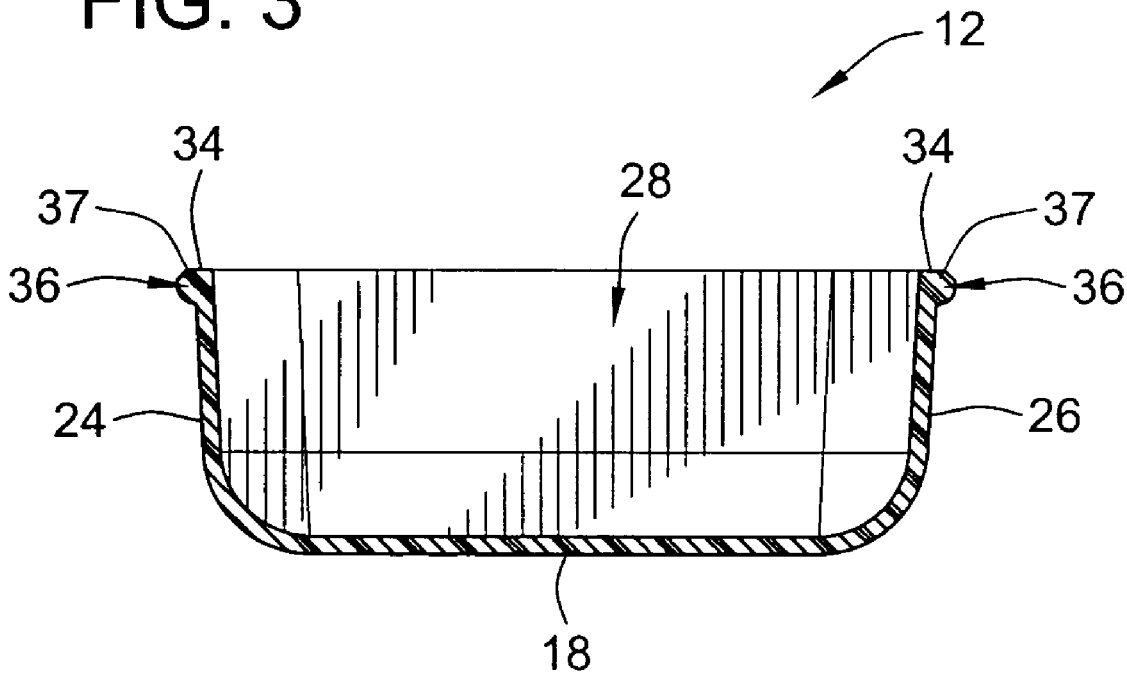
FIG. 3 is a cross-section view of the plastic container base of FIG. 2 taken along line 3-3.

In a preferred embodiment as depicted in FIG. 3, the engagement system 16 (FIG. 1) includes a pair of first tracks 36 that extend along all or a portion of the sidewalls 24, 26 proximate the peripheral surface 34 of the plastic container base 12. In the disclosed embodiment, each of the pair of first tracks 36 is an elongate, semi-cylindrical, projecting rib, which forms a linear rail 37, that is integrally formed with one of the sidewalls 24, 26.

Figure 4:
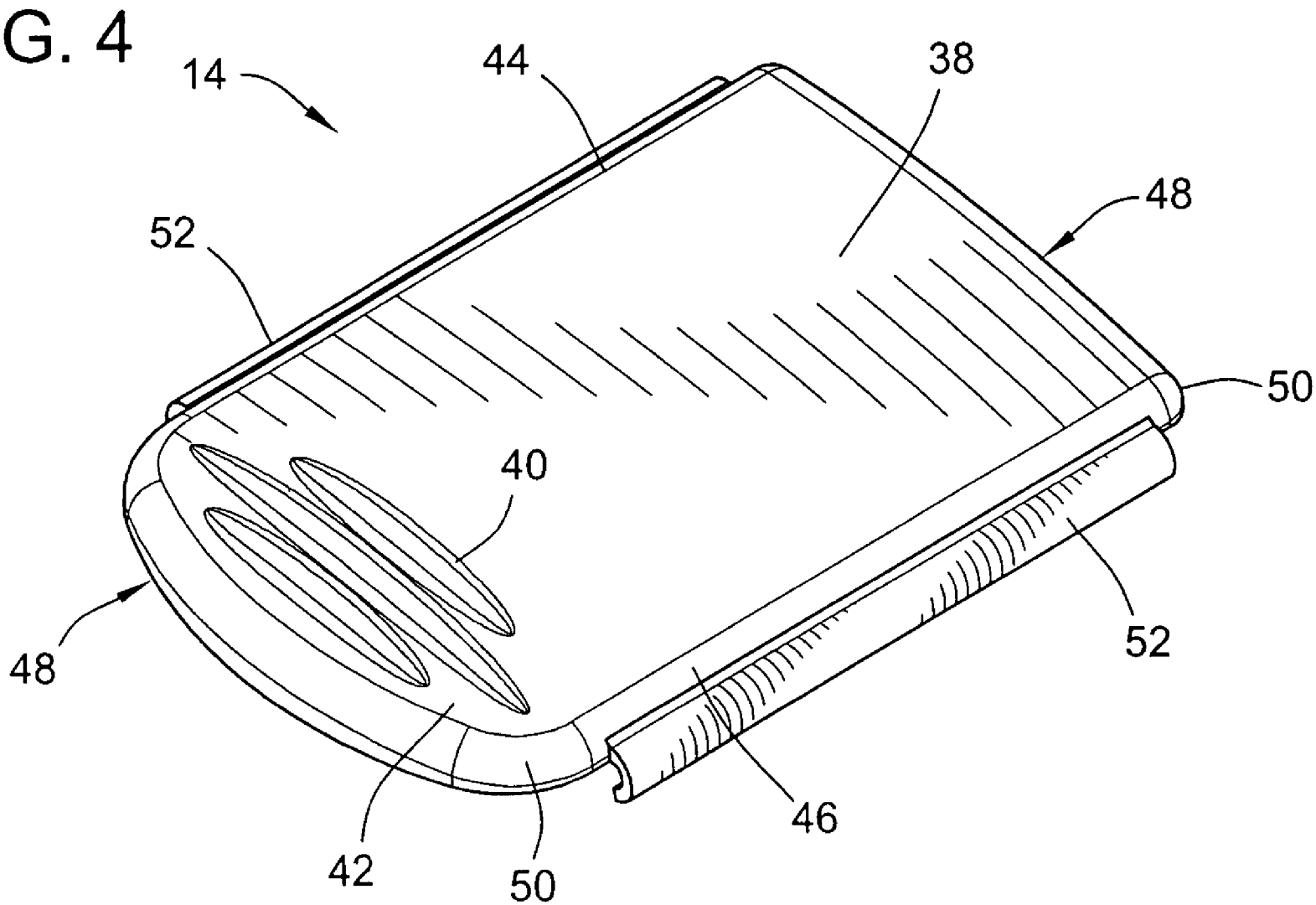
FIG. 4 is a top and front perspective view of a plastic container lid from the container of FIG. 1.

Moving to FIG. 4, the plastic container lid 14 or cover is shown in detail and apart from the plastic container base 12. The plastic container lid 14 includes a cover portion 38 that may have one or more knurls 40 that project upwardly (i.e., away from the bottom 18). The plastic container lid 14 is slideably disposed upon, and engaged with, the plastic container base 12 when the container 10 is assembled as in FIG. 1. Moreover, the plastic container lid 14, and more specifically the cover portion 38, encloses the storage area 18 (FIG. 2).

The knurls 40 provide a surface that permits a finger or thumb to grip the otherwise generally planar cover portion 38 of the plastic container lid 14. In the disclosed embodiment, as illustrated in FIG. 4, the knurls 40 are formed proximate a front portion 42 of the plastic container lid 14. The knurls 40 can be formed from, for example, a single raised portion of the plastic container lid 14, a pattern of raised ribs, an array of projecting dots, a series of indentations, and the like, to form a gripping surface.

In a preferred embodiment, the cover portion 38 has an integrally formed skirt 48 that projects downwardly and extends peripherally around the lid. Corners 50 of the plastic container lid 14, formed by the generally horizontal intersection of the cover portion 38 and the skirt 48 can be rounded or radiused. By smoothing these corners and edges, the container 10 is, as stated before, more comfortably held in the palm of a hand.

Figure 5:
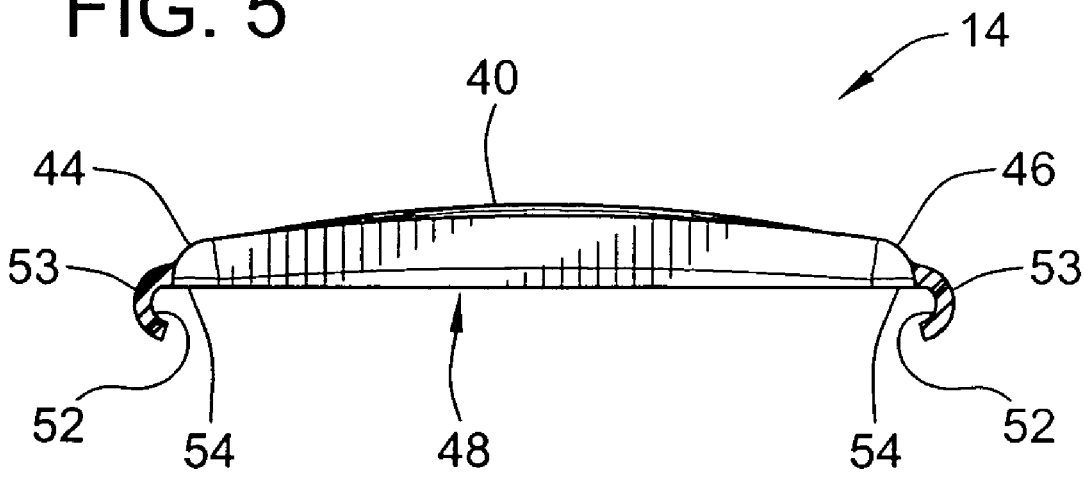
FIG. 5 is a front elevation view of the plastic container lid of FIG. 4 highlighting a second pair of tracks.

Referring now to both FIGS. 4 and 5, in a preferred embodiment the engagement system 16 (FIG. 1) further includes a pair of second tracks 52 that extend along all or a portion of opposing sides 44, 46 proximate a peripheral surface 54 of the plastic container lid 14. The pair of second tracks 52 may stop short of the corners 50 as illustrated. Each of the pair of second tracks 52 is integrally formed with one of the opposing sides 44, 46. In the disclosed embodiment, each of the pair of second tracks 52 is formed into a linear elongate flange 53 projecting outwardly from an exterior surface of the lid 14. The elongate flange 53 has a generally convex outer surface and a concave inner surface that forms a channel to provide for the track 52. The elongate flange 53 is secured to and/or formed upon the cover portion 38 of the plastic container lid 14 and, more particularly, on an outside surface of the plastic container lid. The flange 53 on either side of the container 10 can be are secured to the skirt 48 (i.e., the sides 44, 46) proximate the peripheral surface 54 of the plastic container lid 14 and extend down over an exterior surface of the plastic container base 12.

The pair of second tracks 52 is dimensioned to slideably engage with the pair of first tracks 36 as illustrated in FIG. 1. The pairs of first and second tracks 36, 52 can be sized such that they provide the container 10 with a friction fit when engaged or, alternatively, can be sized such that they couple in a somewhat more freely and easily slideable arrangement. The tracks 36, 52, in addition to mating to provide for linear reciprocation, also interlock and cooperate to retain the lid on the container base (e.g., via tongue and groove interlock between the channel and rib/rail).

Figure 6:
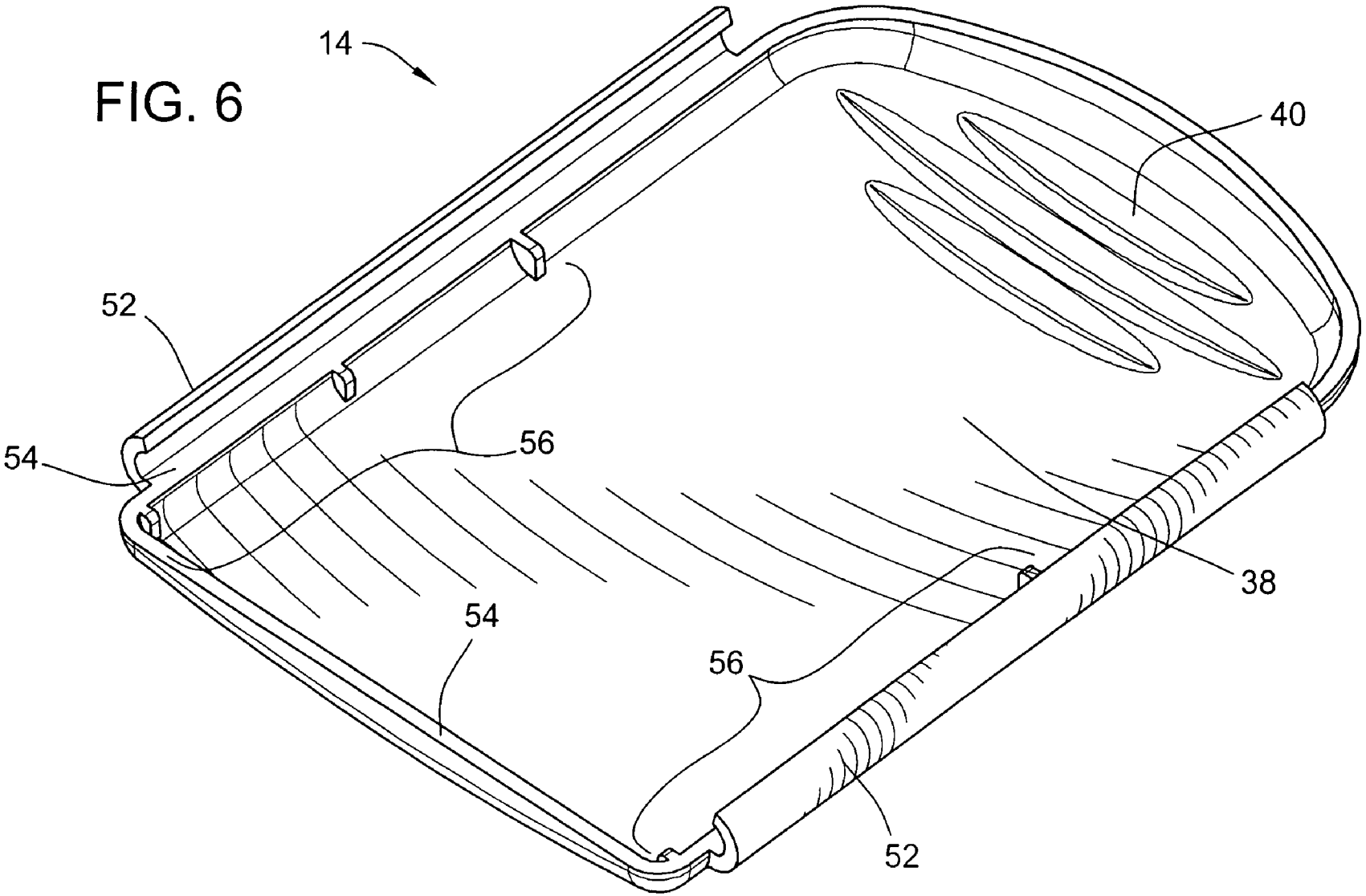
FIG. 6 is a bottom and back perspective view of the plastic container lid from FIG. 4 highlighting a plurality of downwardly depending detents.

As shown in FIG. 6, when the plastic container lid 14 of FIG. 4 is turned over, the plastic container lid reveals a plurality of detents 56. The detents 56 are formed from a resilient material such as, for example, plastic and, in preferred embodiments, are integrally formed with the plastic container lid 14. In the disclosed embodiment, the detents 56 are depicted in the form of plastic webs that generally extends downwardly (toward the bottom 18) when the container 10 is assembled as shown in FIG. 1 and, preferably, do not protrude below the peripheral surface 54 of the plastic container base as indicated in FIG. 5. As illustrated in FIG. 6, the detents 56 are dispersed along the opposing sides 44, 46 of the plastic container lid 14 in spaced relation with one another, and specifically linearly spaced along the linear travel path of the lid.

Figure 7:
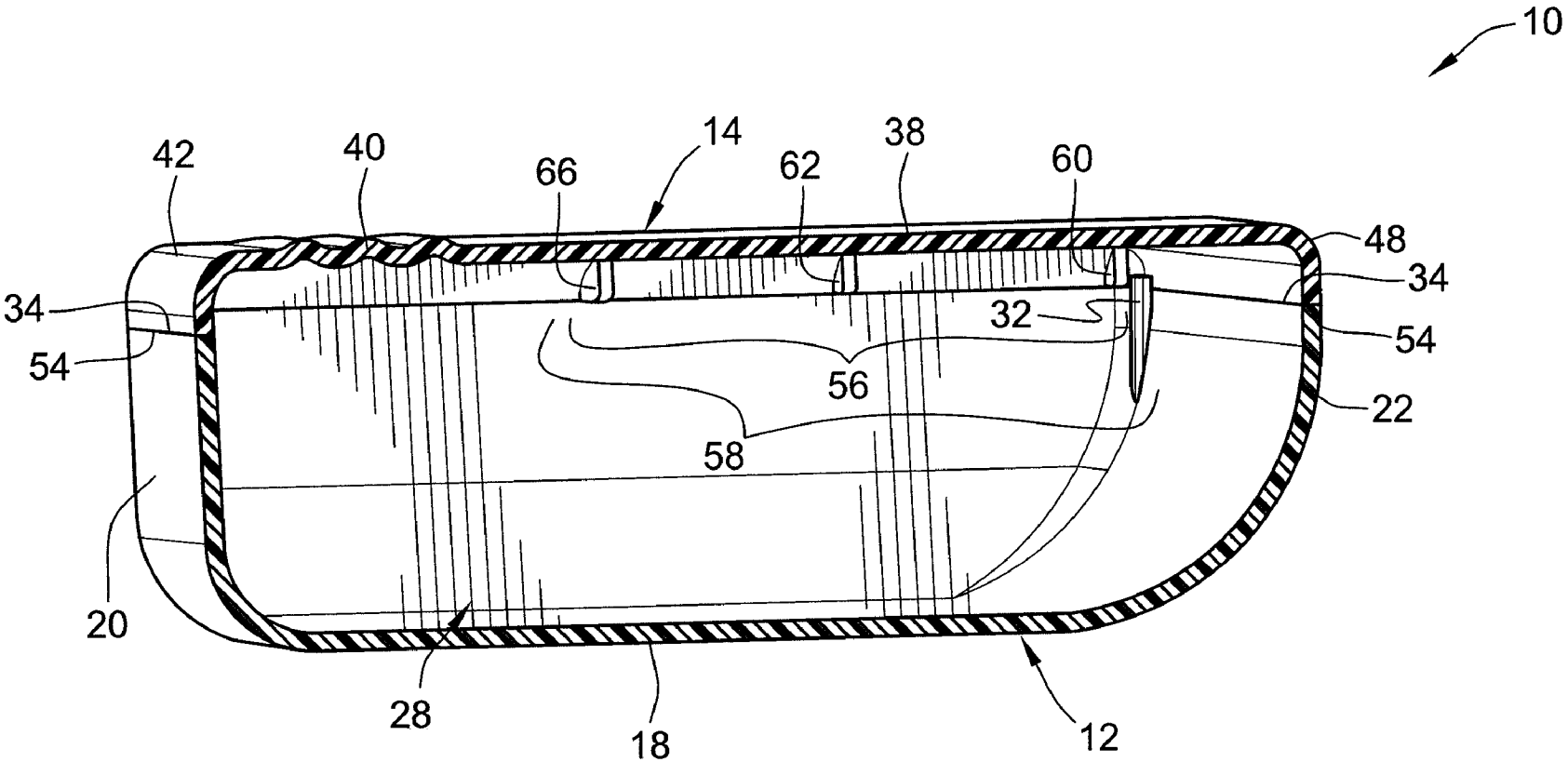
FIG. 7 is a cross-section view of the container of FIG. 1 in a closed position taken along line 7-7.
Figure 8:
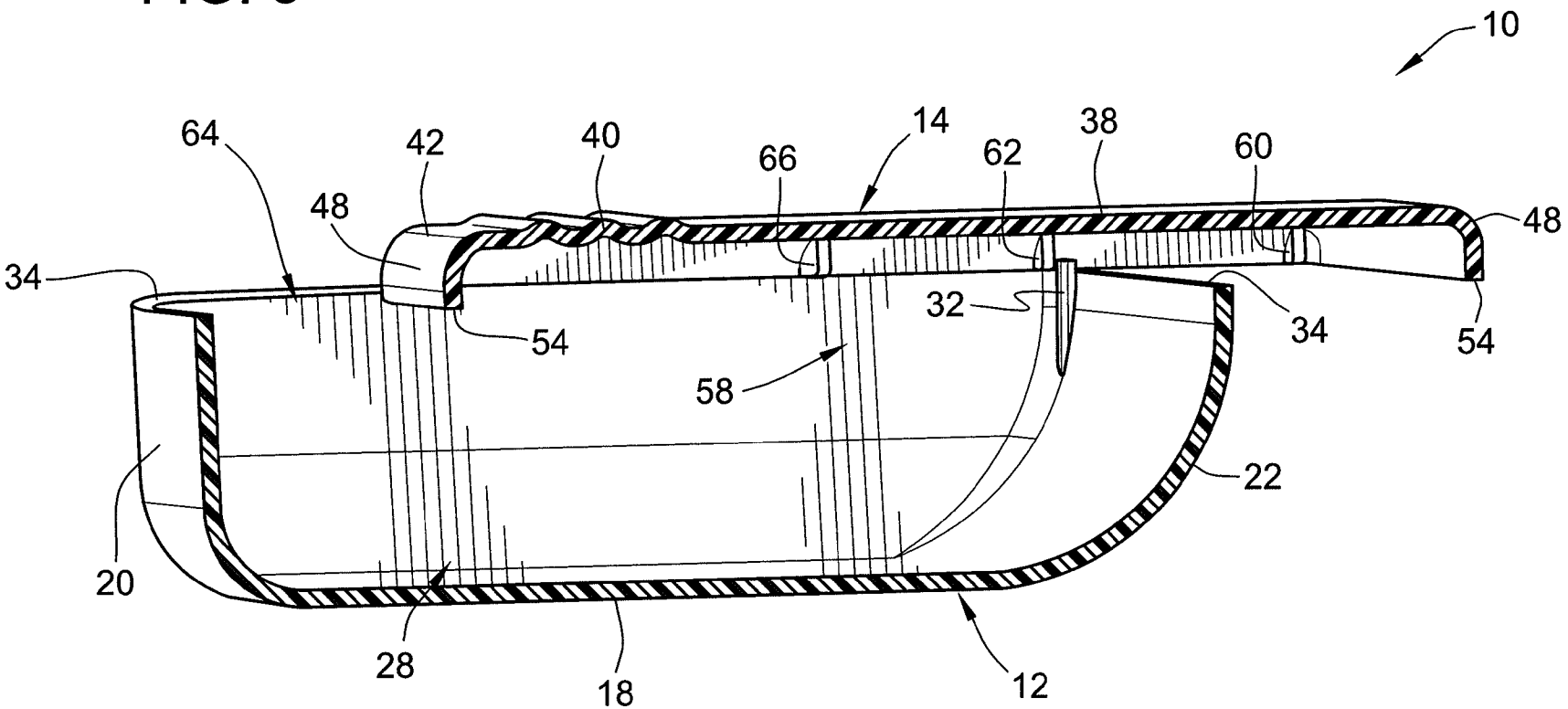
FIG. 8 is a cross-section view of the container of FIG. 7 after the plastic container lid has been slid relative to the plastic container base to place the container in a partially open position.
Figure 9:
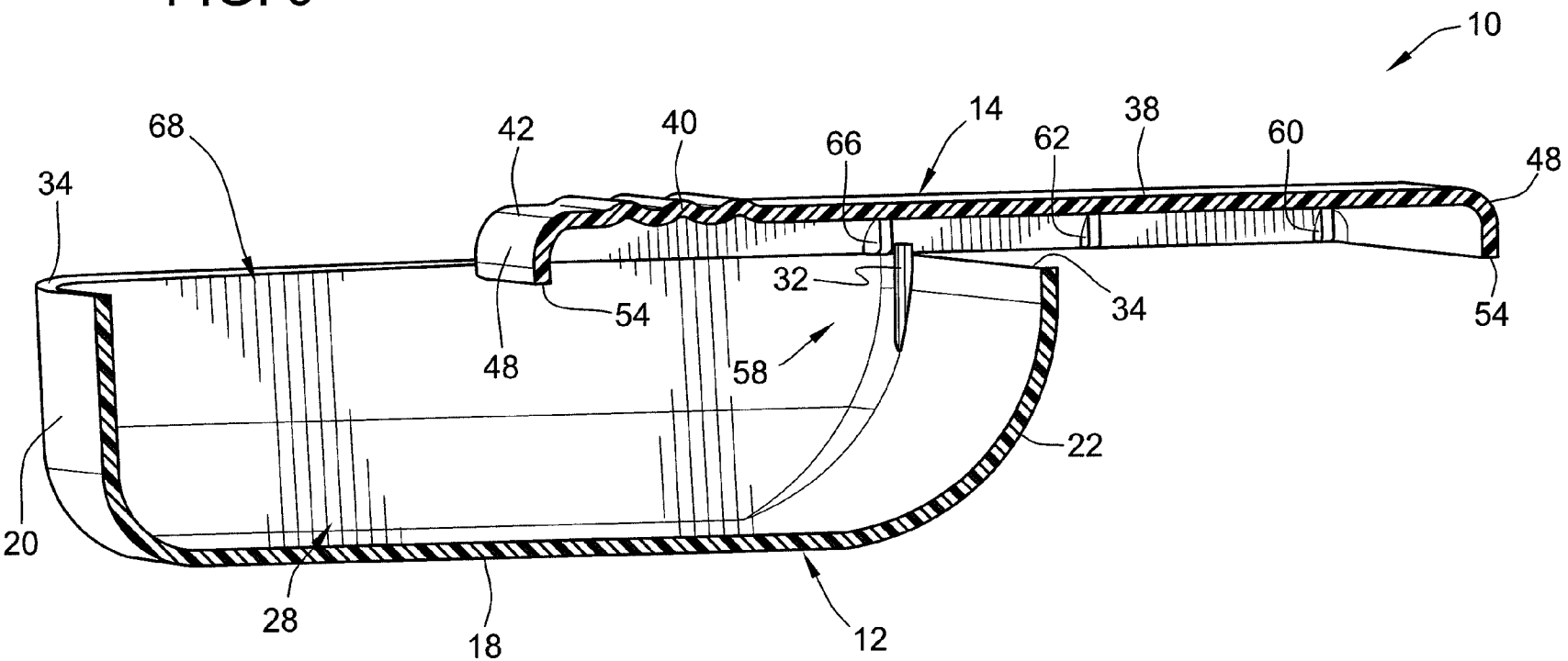
FIG. 9 is a cross-section view of the container of FIG. 8 after the plastic container lid has been further slid relative to the plastic container base to place the container in a fully open position.

As generally shown in FIGS. 7-9, the catch 32 and the plurality of detents 56 are cooperating components that form a stop mechanism 58 on the container 10. The catch 32 and each of the detents 56 are selectively engaged and resiliently disengaged so that the plastic container lid 14, which is guided by the engaged pairs of first and second tracks 36, 52, slides linearly relative to the plastic container base 12. In one embodiment, as the plastic container lid 14 moves relative to the plastic container base 12, the peripheral surface 54 slides upon and over the peripheral surface 34.

Referring specifically to FIG. 7, the container 10 is depicted in a "closed" position. In the closed position, the catch 32 is engaged with a first detent 60 (from the plurality of detents 56). The first detent 60 is disposed farthest from the front portion 42 of the plastic container lid 14 and/or the front end 20 of the plastic container base 12. Also, in the closed position, the peripheral surfaces 34, 54 are generally aligned around the entire periphery of the container 10 such that the storage area 28 is enclosed. Therefore, any products and/or items disposed in the storage area 28 are securely stored and maintained within the container 10.

Continuing to FIG. 8, the container 10 is shown in a first or "partially open" position. In the disclosed embodiment, the partially open position is achieved by linearly sliding the plastic container lid 14 relative to plastic container base 12. In the partially open position, the catch 32 is engaged with a second detent 62 (from the plurality of detents 56) disposed somewhat in the central portion of the plastic container lid 14. The plastic container lid 14 and the plastic container base 12 are offset to form a dispensing opening 64 between the front end 20 of the plastic container base 12 and a front portion 42 of the skirt 48. The dispensing opening 64 permits any products and/or items held in the storage area 28 of the container 10 to be dispensed.

Moving now to FIG. 9, the container 10 is shown in a second or "fully open" position. In the fully open position, the catch 32 is engaged with a third detent 66 (from the plurality of detents 56) disposed somewhat in the central portion of the plastic container lid 14 yet further away from the first detent 60 than the second detent 62. Moreover, the peripheral surface 54 of the plastic container lid 14 and the peripheral surface 34 of the plastic container base 12 are even further misaligned with each other, when compared to the partially opened container of FIG. 8, to form an enlarged dispensing opening 68 between the front end 20 of the plastic container base 12 and a forward edge 42 of the cover portion 38 and/or skirt 48. The enlarged dispensing opening 68 generally permits any products and/or items held in the storage area 28 of the container 10 to be dispensed more freely than the dispensing opening 64 (FIG. 8).

In operation, the container 10 is manipulated, using a finger and/or thumb, between the closed, partially open, and fully open positions. In these different discrete positions, the container 10 can repeatedly, alternatively dispense and store goods and/or a product. Further, those skilled in the art will recognize that more or fewer detents and/or catches (compared to FIGS. 7-9) can be provided to a container and, therefore, provide the container with a number different discrete positions.

While preferred configurations are illustrated, it will be understood that the ribs and channels of first and second tracks 36, 52 can be interchanged with each other. In other words, the ribs and channels pairs of first and second tracks 36, 52 can be operationally coupled and/or cooperatively arranged on the container base and the container lid, respectively or vice versa. Likewise, the catch 32 and the plurality of detents 56 can be interchanged with each other and, therefore, operationally coupled and/or cooperatively arranged on the container base and the container lid, respectively or vice versa.

Figure 10:
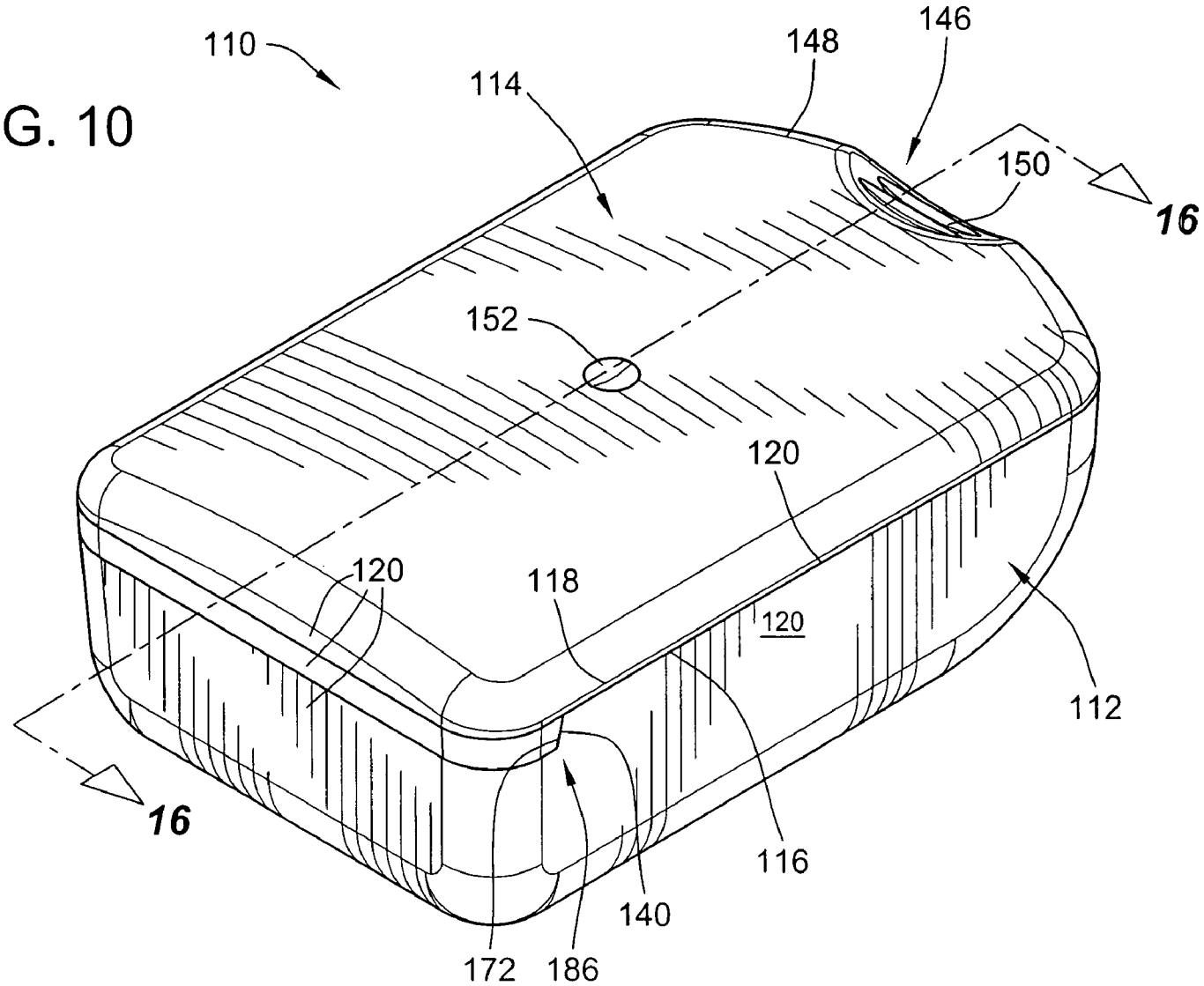
FIG. 10 is a top and back perspective view of an alternate exemplary embodiment of a container as constructed in accordance with the teachings of the present invention.

Referring to FIG. 10, an additional preferred embodiment of a container 110 is illustrated. Since the container 110 is similar in some aspects to the container 10, only particular features of the container 110 will be described in detail. As depicted in FIG. 10, the container 110 includes a plastic container base 112 and a plastic container lid 114. The plastic container lid 114 fits neatly on top of the plastic container base 112 such that the outer periphery 116 of the container base and the outer periphery 118 of the container lid are aligned with each other. Therefore, where the container base 112 and the container lid 114 are joined together, they provide the container 110 with a smooth, and preferably planar outer (i.e., exterior) surface 120. Advantageously, the outer surface of this container 110 is free of projections or surface interruptions that result from a slide engagement system as per the first embodiment. In this embodiment, the slide engagement system is contained such that the outer surface of the container is kept smoother.

Figure 11:
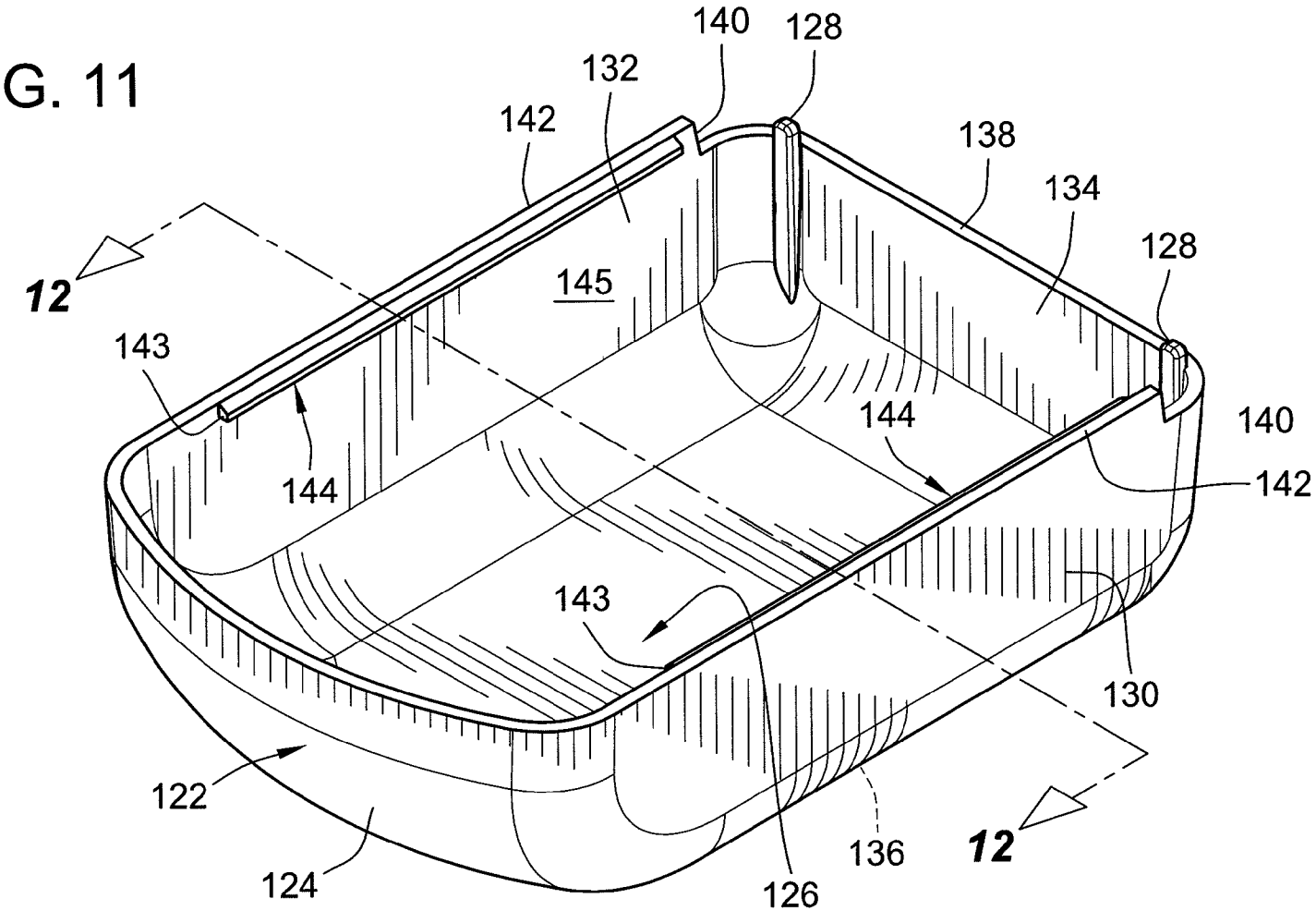
FIG. 11 is a top and front perspective view of a plastic container base from the container of FIG. 10 highlighting a pair of first tracks and an upwardly protruding catch.

Referring to FIG. 11, the plastic container base 112 includes a dispensing chute 122 formed by an outwardly curved front end 124 of the base. The dispensing chute 122 promotes disbursement of the product that is temporarily stored within a storage area 126 in the container 110. The plastic container base 112 also includes one or more catches 128. These catches 128 are formed from a resilient material and can be integrally formed and molded with the plastic container base 112. The catches 128 are disposed upon the plastic container base 112 proximate an intersection of the sidewalls 130, 132 and the back end 134. Similar to the first embodiment, the catches 128 are depicted in the form of a tab or prong that generally extends upwardly (away from the bottom 136) and, preferably, protrude above a rear peripheral surface 138 of the plastic container base 112.

Along the top, the plastic container base 112 also includes one or more steps 140 formed in the side peripheral surfaces 142. The steps 140 are formed such that the side peripheral surfaces 142 are elevated above the rear peripheral surface 138. As shown in FIG. 11, the steps 140 can be sloped forwardly toward the front end 124 as they progress away from the bottom 126. Preferably the steps 140 are located on both sidewalls 130, 132 and at a location that is closer to the back end 134 than the front end 124.

Figure 12:
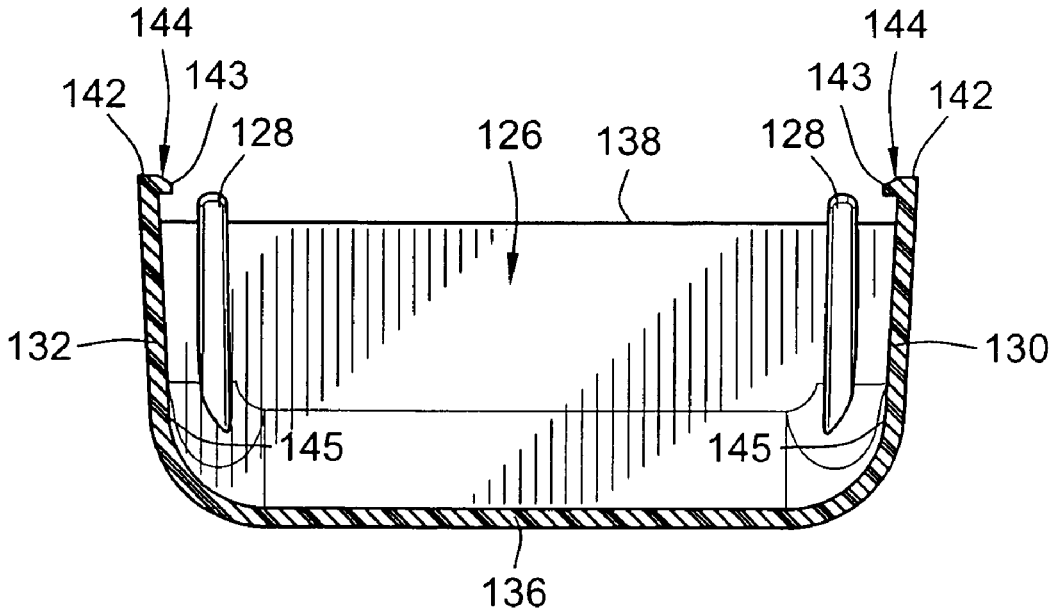
FIG. 12 is a cross-section view of the plastic container base of FIG. 11 taken along line 12-12.

As illustrated in FIGS. 11-12, the plastic container base 112 further includes a pair of first tracks 144. The first tracks 144 extend along all or a portion of the interior surface 145 of the sidewalls 130, 132 proximate the peripheral surface 142 of the plastic container base 112. In the illustrated embodiment, each of the pair of first tracks 144 is an elongate, trapezoidal and inwardly projecting rib that forms a linear rail 143 that is integrally formed with one of the sidewalls 130, 132.

Figure 13:
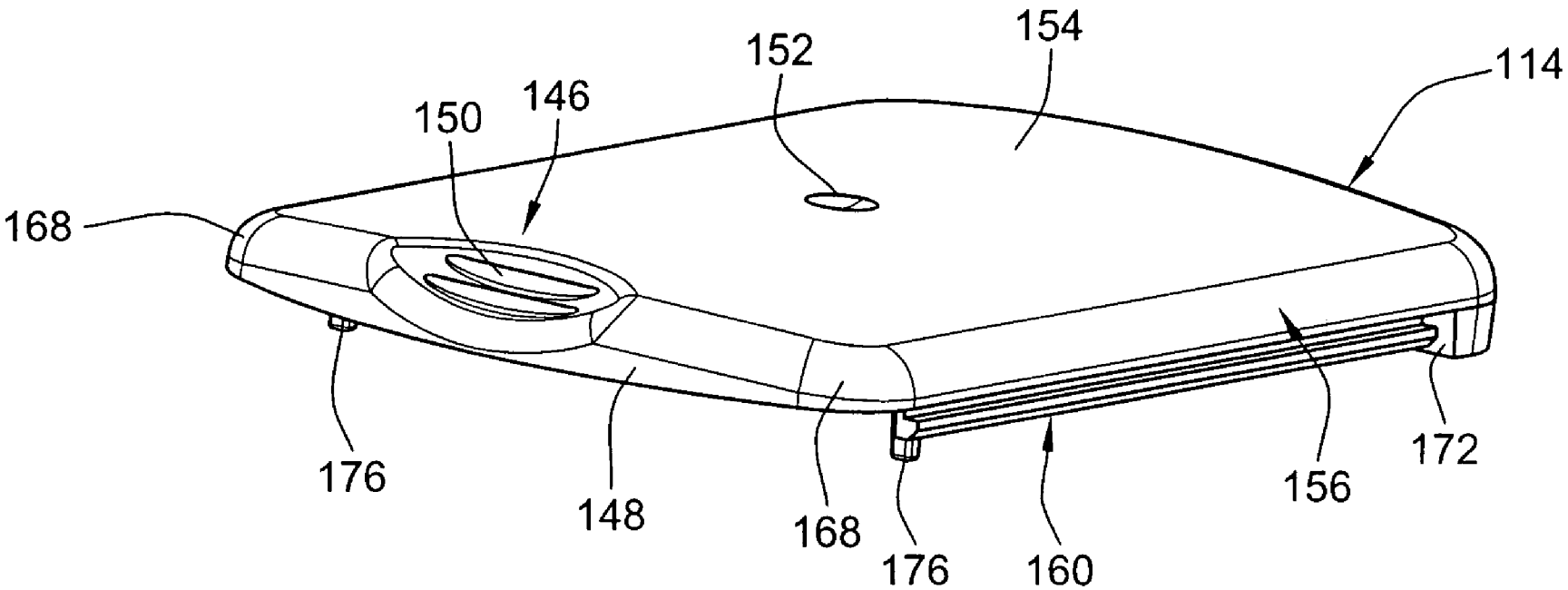
FIG. 13 is a top and front perspective view of a plastic container lid from the container of FIG. 10.

As shown in FIG. 13, the container lid 114 includes an oblong or crescent-shaped depression 146 formed in a forward portion 148. The depression 146 is sized to receive a single digit (i.e., a finger or a thumb) and preferably includes one or more knurls 150 that assist in gripping and biasing the container lid 114. The container lid 114 can further include a circular depression 152 that is formed during the manufacturing process. The plastic container lid 114 is slideably disposed upon, and engaged with, the plastic container base 112 when the container 110 is assembled as in FIG. 10. Moreover, the plastic container lid 114, and more specifically the cover portion 154, encloses the storage area 126 (FIG. 11). In a preferred embodiment, the cover portion 154 has an integrally formed skirt 156 that projects downwardly and extends peripherally around the lid.

Figure 14:
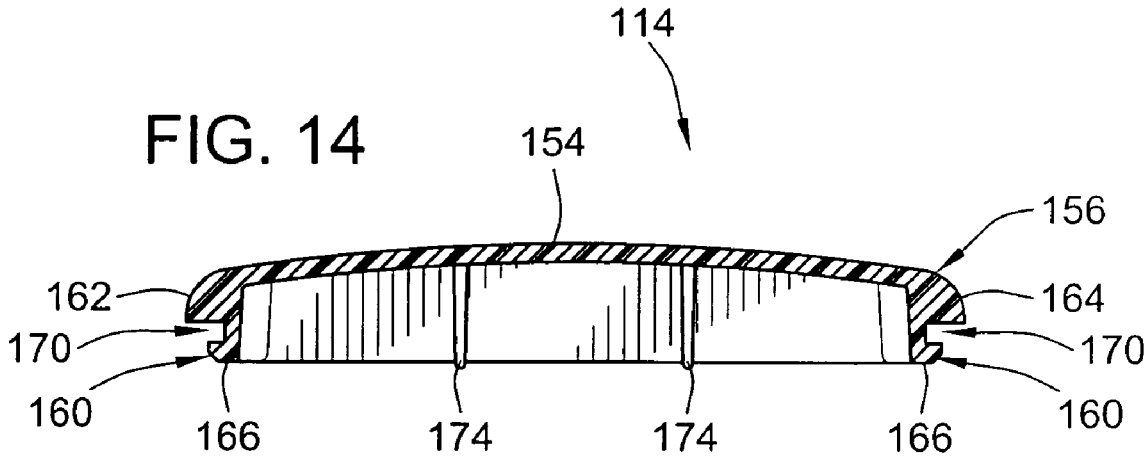
FIG. 14 is a front elevation view of the plastic container lid of FIG. 13 highlighting a second pair of tracks.

Referring now to both FIGS. 13 and 14, the container lid 114 further includes a pair of second tracks 160 that extend along all or a portion of opposing sides 162, 164 proximate a peripheral surface 166 of the plastic container lid 114. Preferably, the pair of second tracks 160 generally stop short of the corners 168 and terminate in the back wall of the skirt. Each of the pair of second tracks 160 is integrally formed with one of the opposing sides 162, 164. In the disclosed embodiment, each of the pair of second tracks 160 takes the form of a linear trapezoidal flange projecting outwardly from a downwardly depending portion of the skirt 156 and/or the cover portion 154 and then outwardly with respect to the circular depression 152 to form an elongate, rectangular channel 170. Rather than being formed into a separate flange, the second tracks 160 are formed inwardly into the skirt sides. As a result, the tracks 160 are spaced inward of the outer peripheral surface of the lid.

Figure 15:
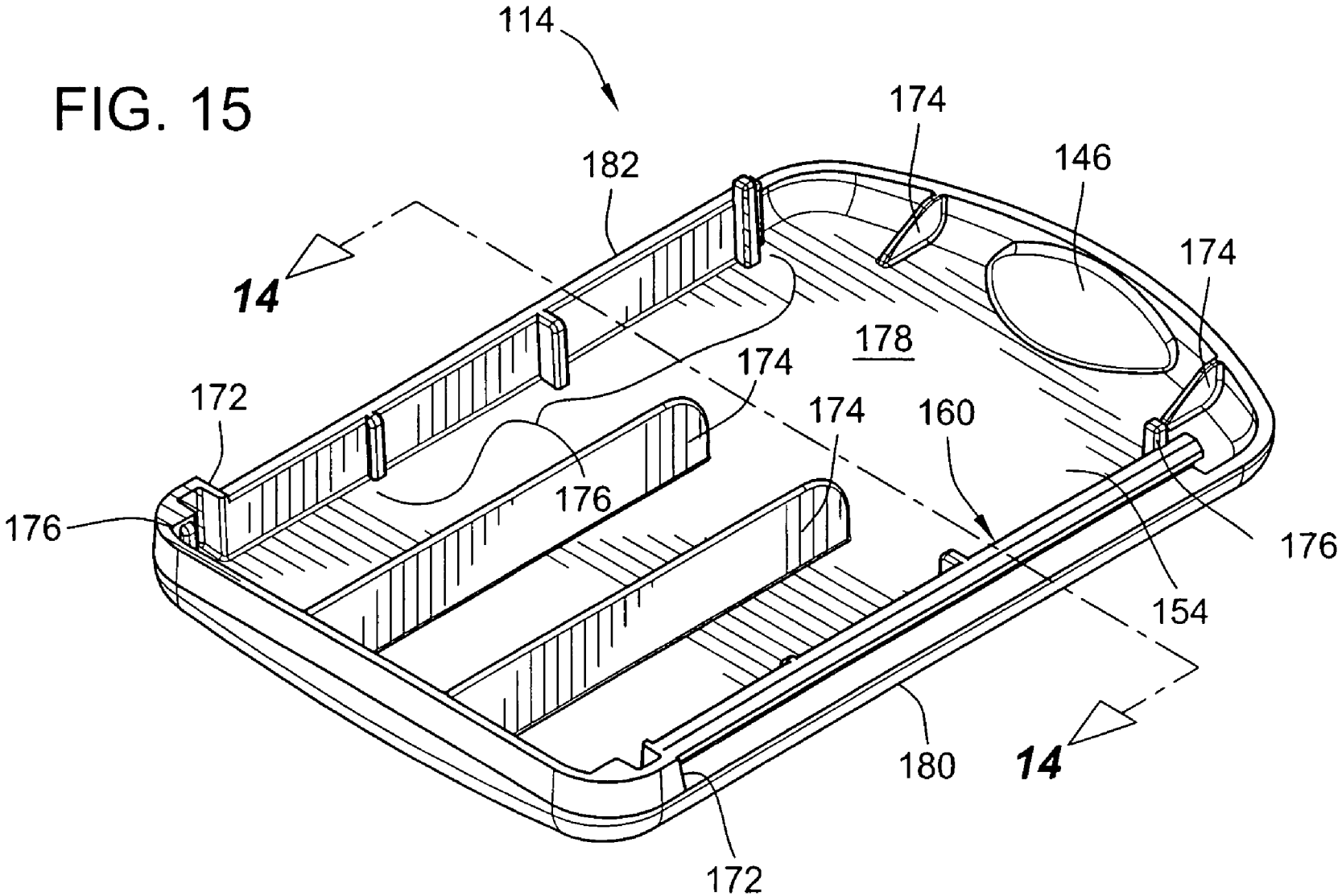
FIG. 15 is a bottom and back perspective view of the plastic container lid from FIG. 13 highlighting a plurality of downwardly depending detents.

As shown in FIG. 15, when the plastic container lid 114 of FIG. 13 is turned over, the plastic container lid reveals abutment surfaces 172, ribs 174, and a plurality of detents 176. The abutment surfaces 172 are adapted to engage the steps 140 (FIG. 11) when the container 110 is assembled (FIG. 10) and prevent the container from opening in reverse. The ribs 174 are located in various positions on an underside 178 of the container lid 114 to provide support to the container lid 114 to prevent, among other things, collapse of the cover portion 154. The ribs 174 also guide the container lid 114 over the rear peripheral surface 138 (FIG. 11) when then the container 110 is opened and closed. The ribs 174 can engage the top of the container in at least one and preferably each of the open positions for support purposes.

The detents 176 are formed from a resilient material such as, for example, plastic and, in preferred embodiments, are integrally formed with the plastic container lid 114. In FIG. 15, the detents 176 are depicted in the form of plastic webs that generally extend downwardly (toward the bottom 136) when the container 110 is assembled as shown in FIG. 10. Some of the detents 176 can extend farther away from the underside 178 of the container lid 114 than others. As illustrated in FIG. 15, the detents 176 are dispersed along the opposing sides 180, 182 of the plastic container lid 114 in spaced relation with one another.

Figure 16:
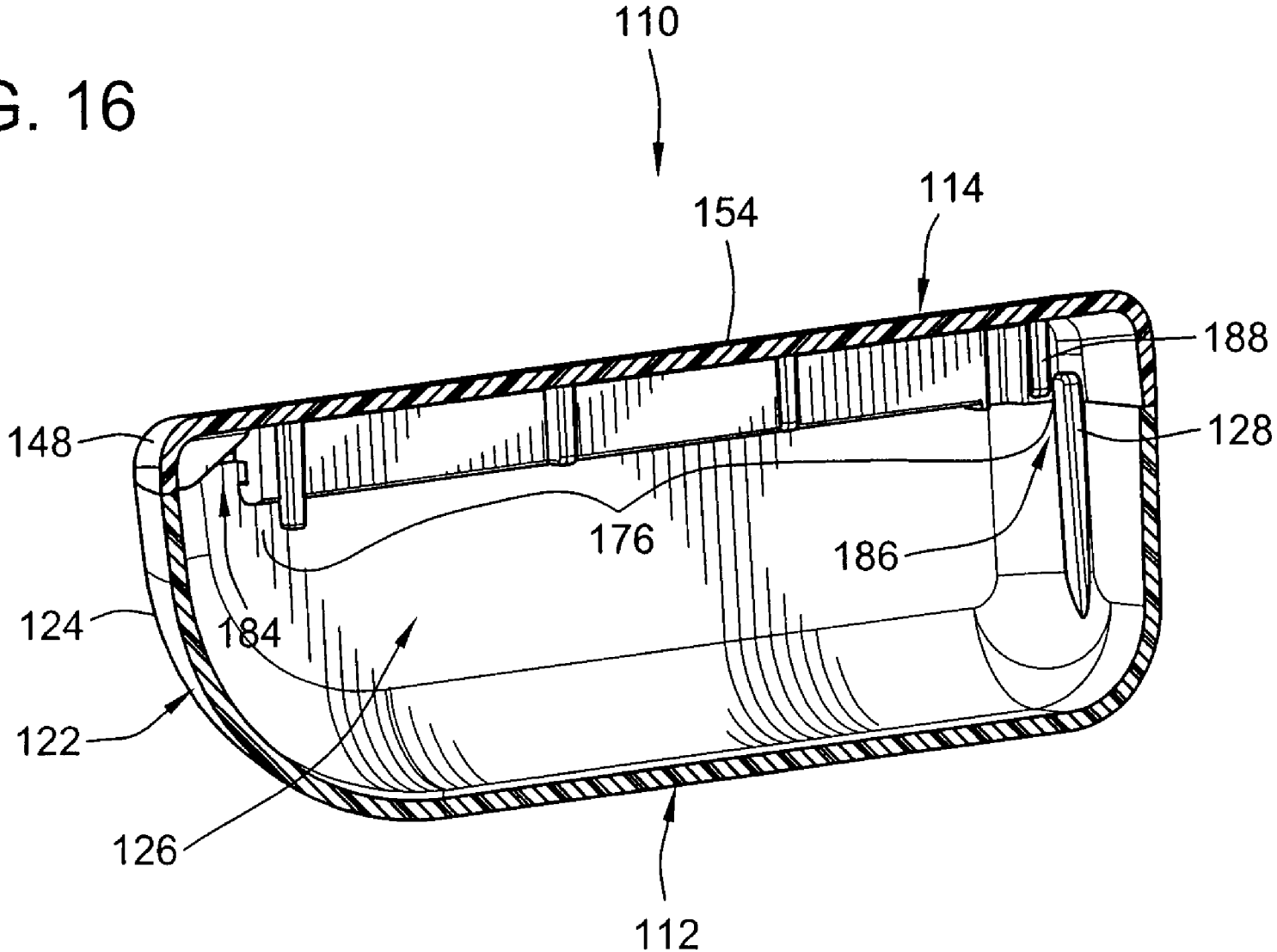
FIG. 16 is a cross-section view of the container of FIG. 10 in a closed position taken along line 16-16.
Figure 17:
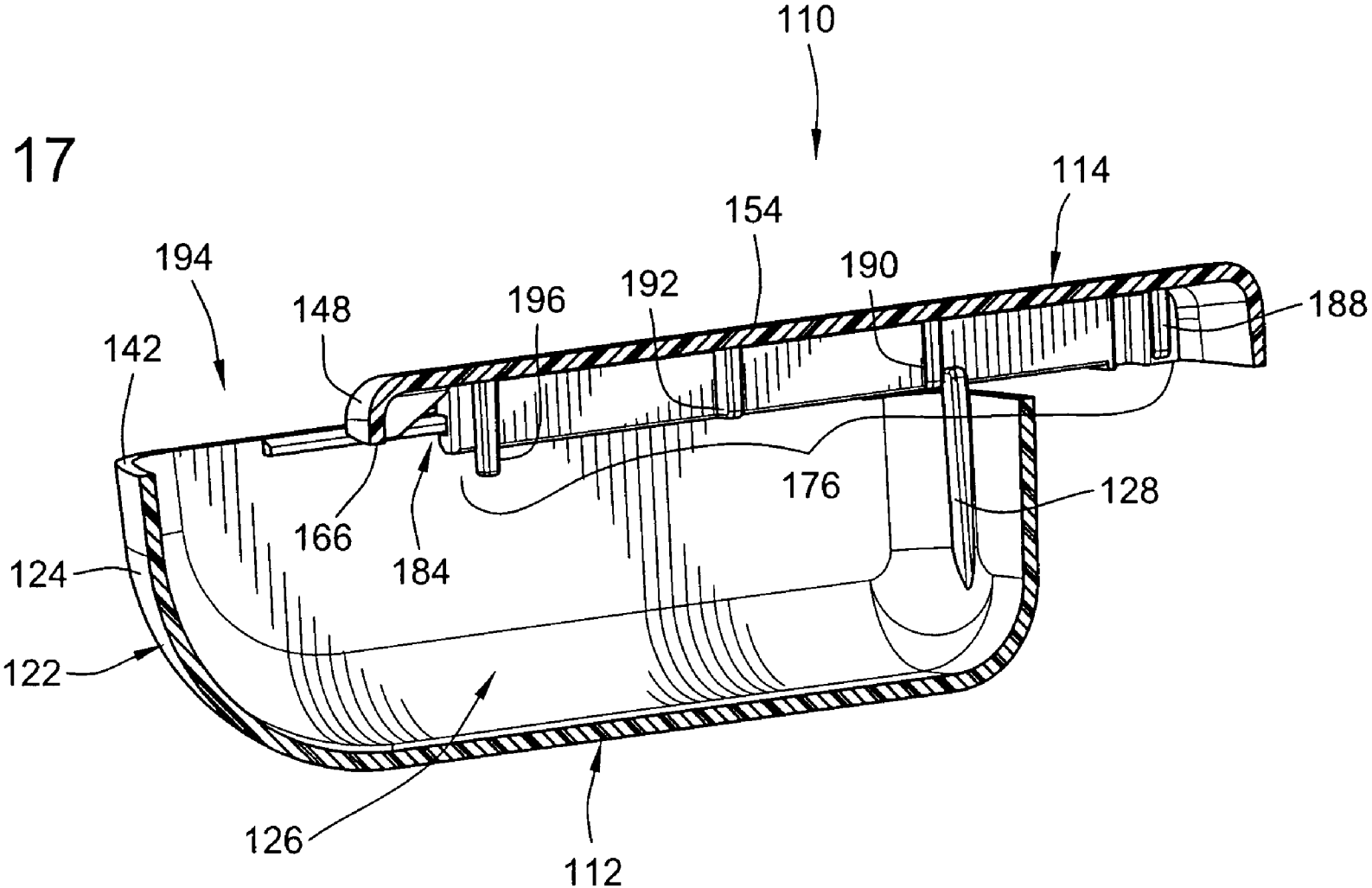
FIG. 17 is a cross-section view of the container of FIG. 16 after the plastic container lid has been slid relative to the plastic container base to place the container in a partially open position.
Figure 18:
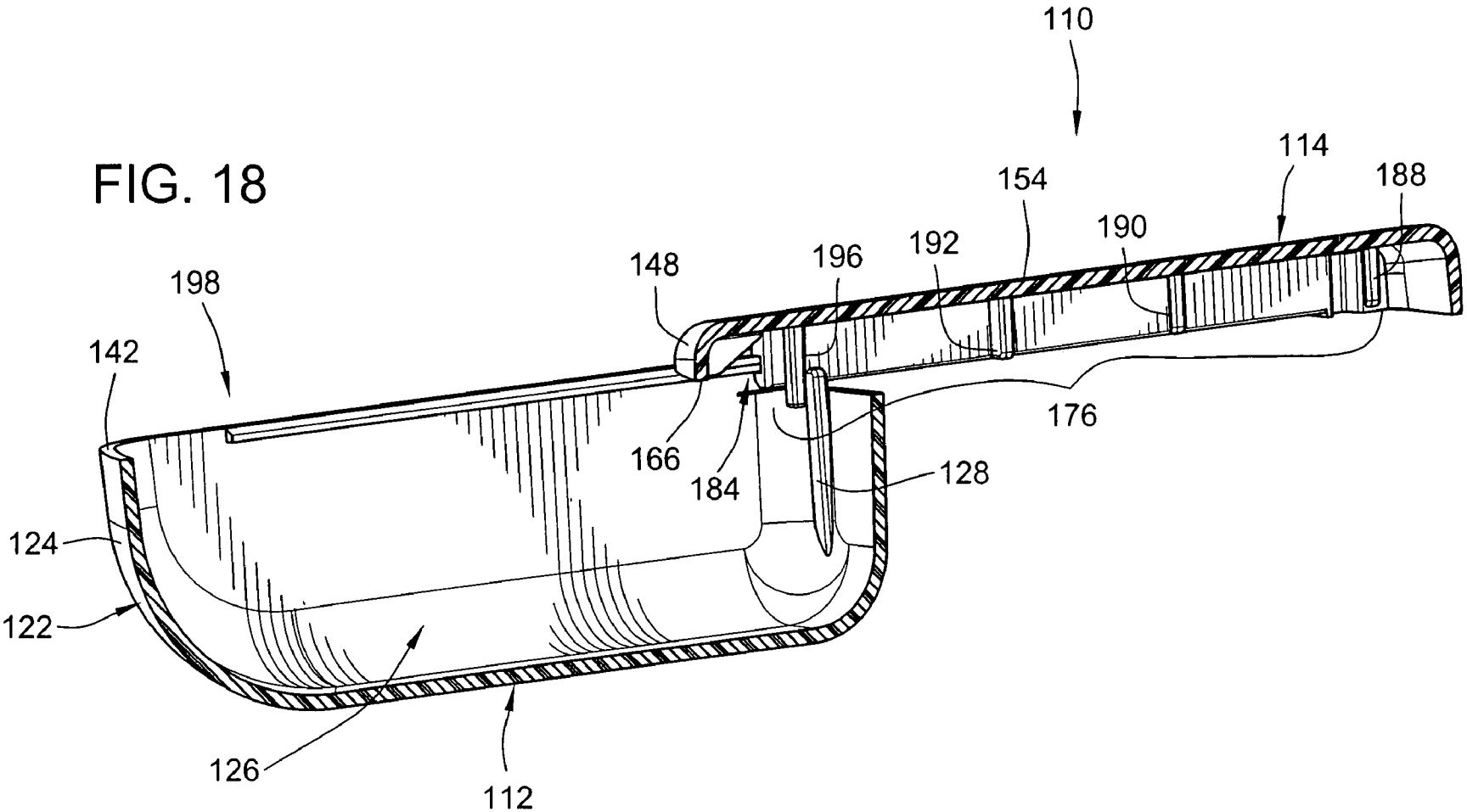
FIG. 18 is a cross-section view of the container of FIG. 17 after the plastic container lid has been further slid relative to the plastic container base to place the container in a fully open position.

The pair of second tracks 160 is dimensioned to slideably engage with the pair of first tracks 144 as collectively illustrated in FIGS. 16-18 to form an engagement system 184. The pairs of first and second tracks 144, 160 can be sized such that they provide the container 110 with a friction fit when engaged or, alternatively, can be sized such that they couple in a somewhat more freely and easily slideable arrangement.

Still referring to FIGS. 16-18, the catch 128 and the plurality of detents 176 and the steps 140 and the abutment surfaces 172, which form a different type of catch and detent to define or assist in defining a discrete position as shown in FIG. 10, are cooperating components that form a stop mechanism 186 on the container 110. The catch 128 and each of the detents 176 are selectively engaged and resiliently disengaged so that the plastic container lid 114, which is guided by the engaged pairs of first and second tracks 144, 160, slides linearly relative to the plastic container base 112. The steps 140 and the mating abutment surfaces 172 are progressed toward each other until they contact one another and prevent further relative movement of the container lid 114 with respect to the container base 112.

Referring specifically to FIG. 16, the container 110 is depicted in a "closed" position. In the closed position, the catch 128 is engaged with a first detent 188 (from the plurality of detents 176). The first detent 188 is disposed farthest from the forward portion 148 of the plastic container lid 114 and/or the front end 124 of the plastic container base 112. Moreover, the steps 140 and the abutment surfaces 172 are in intimate contact with each other (FIG. 10).

Continuing to FIG. 17, the container 110 is shown in one of two possible "partially open" positions. The illustrated partially open position is achieved by linearly sliding the plastic container lid 114 relative to plastic container base 112 until the catch 128 is engaged with a second detent 190 (from the plurality of detents 176) disposed somewhat in the central portion of the plastic container lid 114. The container 110 can be placed in another partially open position by continuing to slide the container lid 114 relative to the container base 112 until a third detent 192 engages the catch 128. Notably, portions of the peripheral surfaces 142, 166 that are not adjacent to the pairs of first and second tracks 144, 160 are now misaligned whereas they were aligned in FIG. 16. Moreover, the plastic container lid 114 and the plastic container base 112 are offset to form a dispensing opening 194 between the front end 124 of the plastic container base 112 and a front portion 148 of the skirt 156. The dispensing opening 194 permits any products and/or items held in the storage area 126 of the container 110 to be dispensed. The dispensing chute 122, which is either curved, sloped, ramped, and like, assists in dispersing the product from the storage area 126.

Moving now to FIG. 18, the container 110 is shown in a second or "fully open" position. In the fully open position, the catch 128 is engaged with a fourth detent 196 (from the plurality of detents 176) disposed somewhat in the central portion of the plastic container lid 114 yet further away from the first detent 188 than the other detents 190, 192. The fourth detent 196 preferably extends further away from the cover portion 154 to prevent the plastic container lid 114 from completely disengaging and separating from the plastic container base 112. In the fully open position, the container 110 forms an enlarged dispensing opening 198 between the front end 124 of the plastic container base 112 and a forward edge 148 of the skirt 156. The enlarged dispensing opening 198 generally permits any products and/or items held in the storage area 126 of the container 110 to be dispensed more freely than the dispensing opening 194 (FIG. 17).

Figure 19:
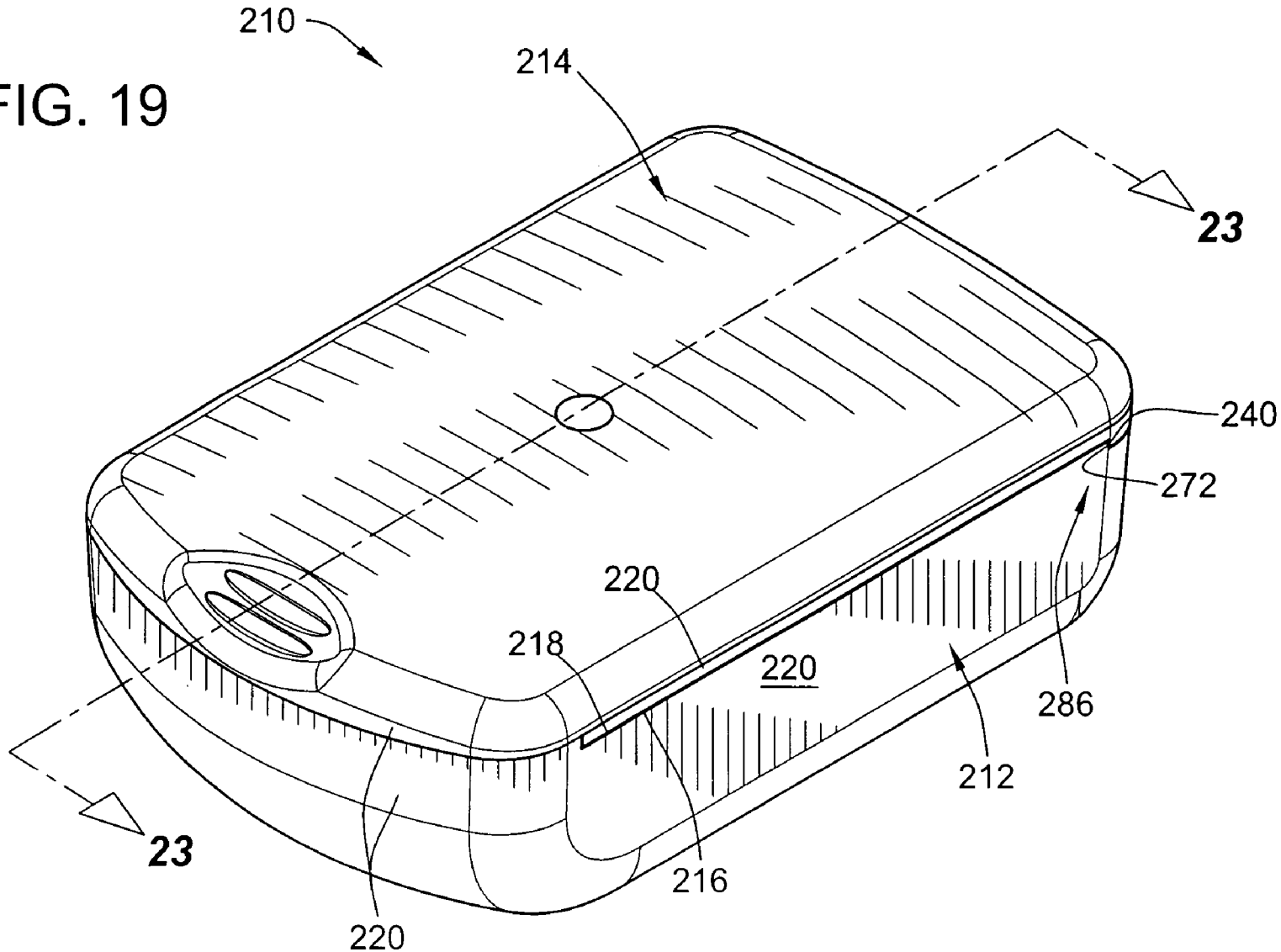
FIG. 19 is a top and front perspective view of an alternate exemplary embodiment of a container as constructed in accordance with the teachings of the present invention.

Referring to FIG. 19, an additional preferred embodiment of a container 210 is illustrated. Since the container 210 is similar in some aspects to the containers 10, 110, only particular features of the container 210 will be described in detail. As depicted in FIG. 19, the container 210 includes a plastic container base 212 and a plastic container lid 214.

Figure 21:
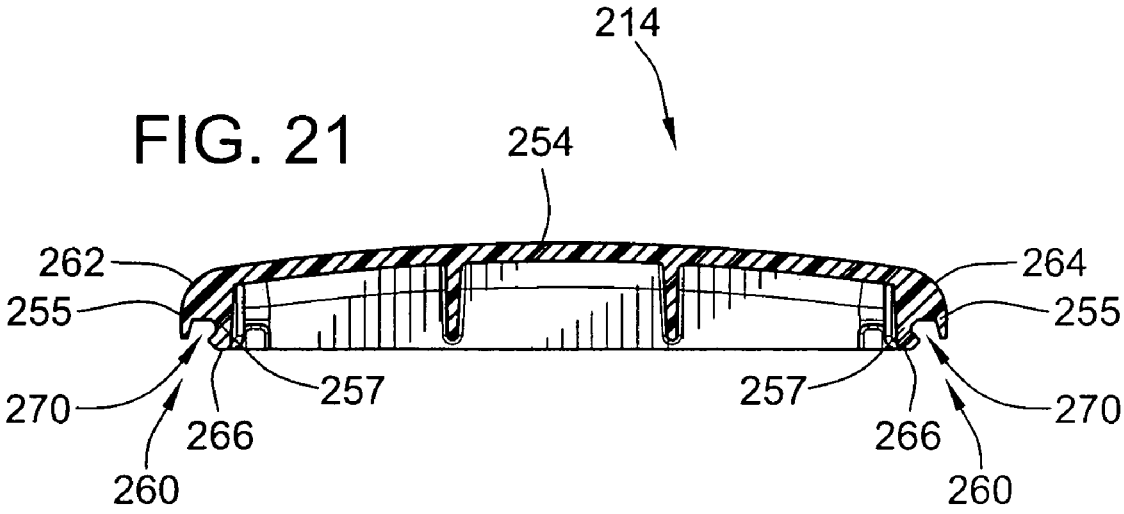
FIG. 21 is a cross-section view of the plastic container lid of FIG. 19.
Figure 20:
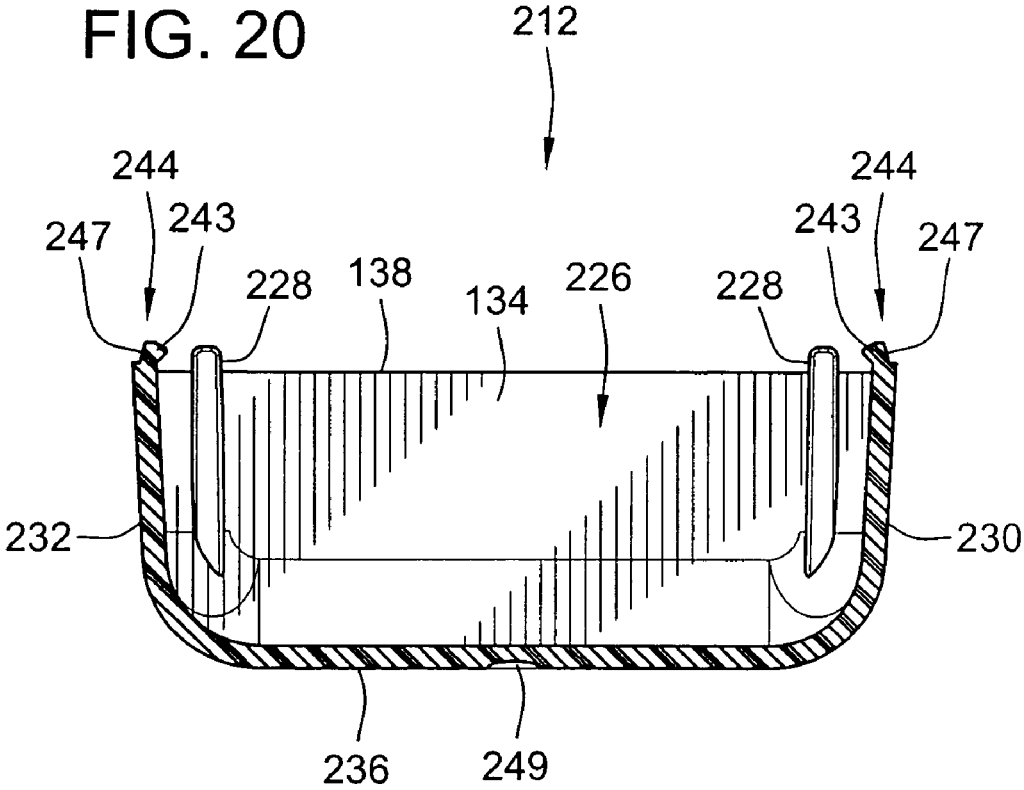
FIG. 20 is a cross-section view of the plastic container base of FIG. 19.

As illustrated in FIG. 20, the plastic container base 212 includes a pair of first tracks 244. In the illustrated embodiment, each of the pair of first tracks 244 is an elongate, trapezoidal and inwardly projecting rib that forms a linear rail 243 and a corresponding elongate, canted and outwardly and upwardly open groove 247 in spaced apart relation. Referring now to both FIG. 21, the container lid 214 further includes a pair of second tracks 260. In the disclosed embodiment, each of the pair of second tracks 260 takes the form of an outer downwardly depending flange 255 spaced apart from an inner downwardly depending flange 257. The outer downwardly depending flange 255 is canted to match the angle of the groove 247. The inner downwardly depending flange 257 has a linear trapezoidal flange projecting outwardly from the downwardly depending flange and/or the cover portion 254 and then outwardly to form an elongate, channel 270. Rather than being formed into a separate flange, the second tracks 260 are formed upwardly into the skirt sides. As a result, the tracks 260 are spaced inward of the outer peripheral surface of the lid.

Figure 22:
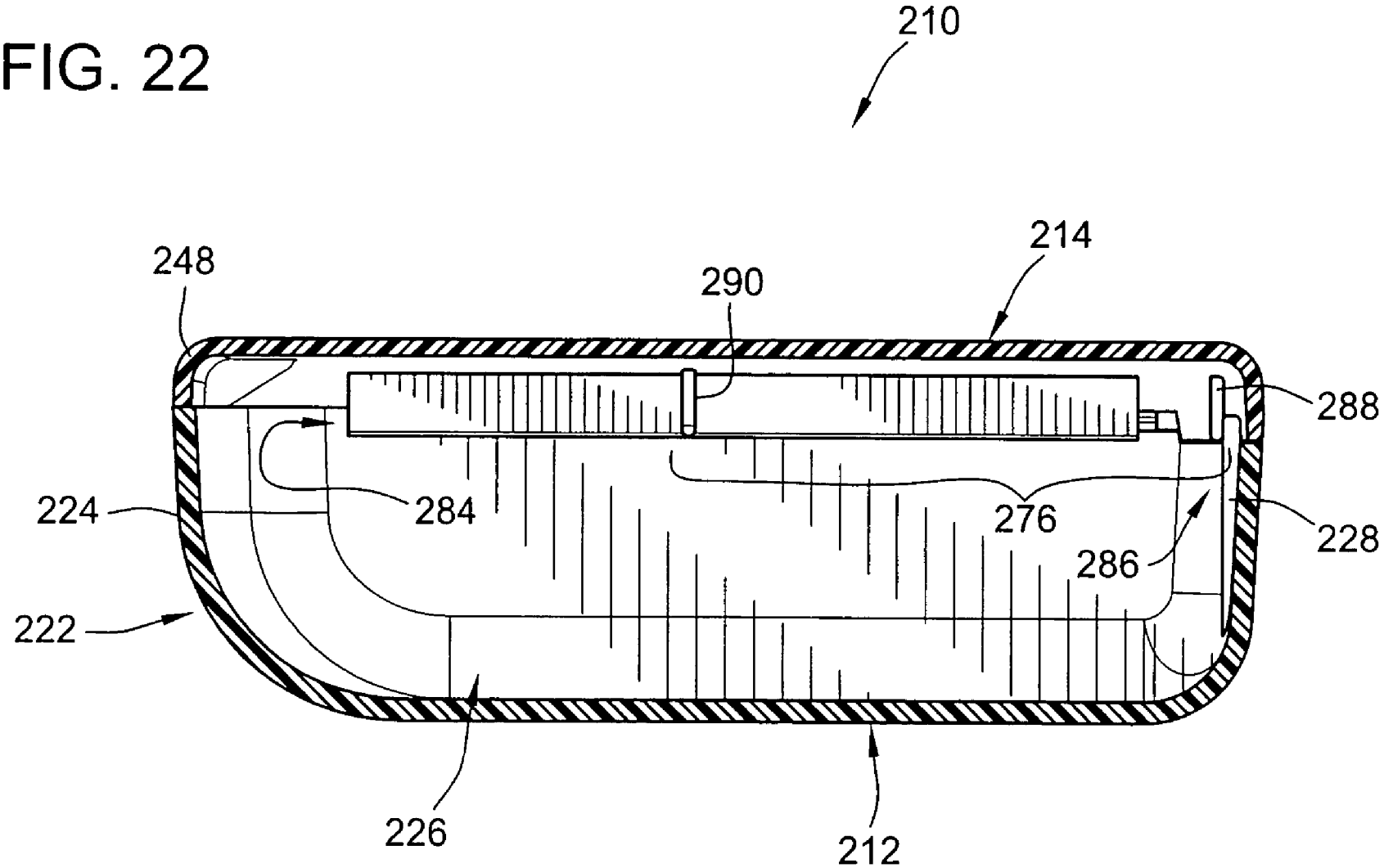
FIG. 22 is a cross-section view of the container of FIG. 19 in a closed position.
Figure 23:
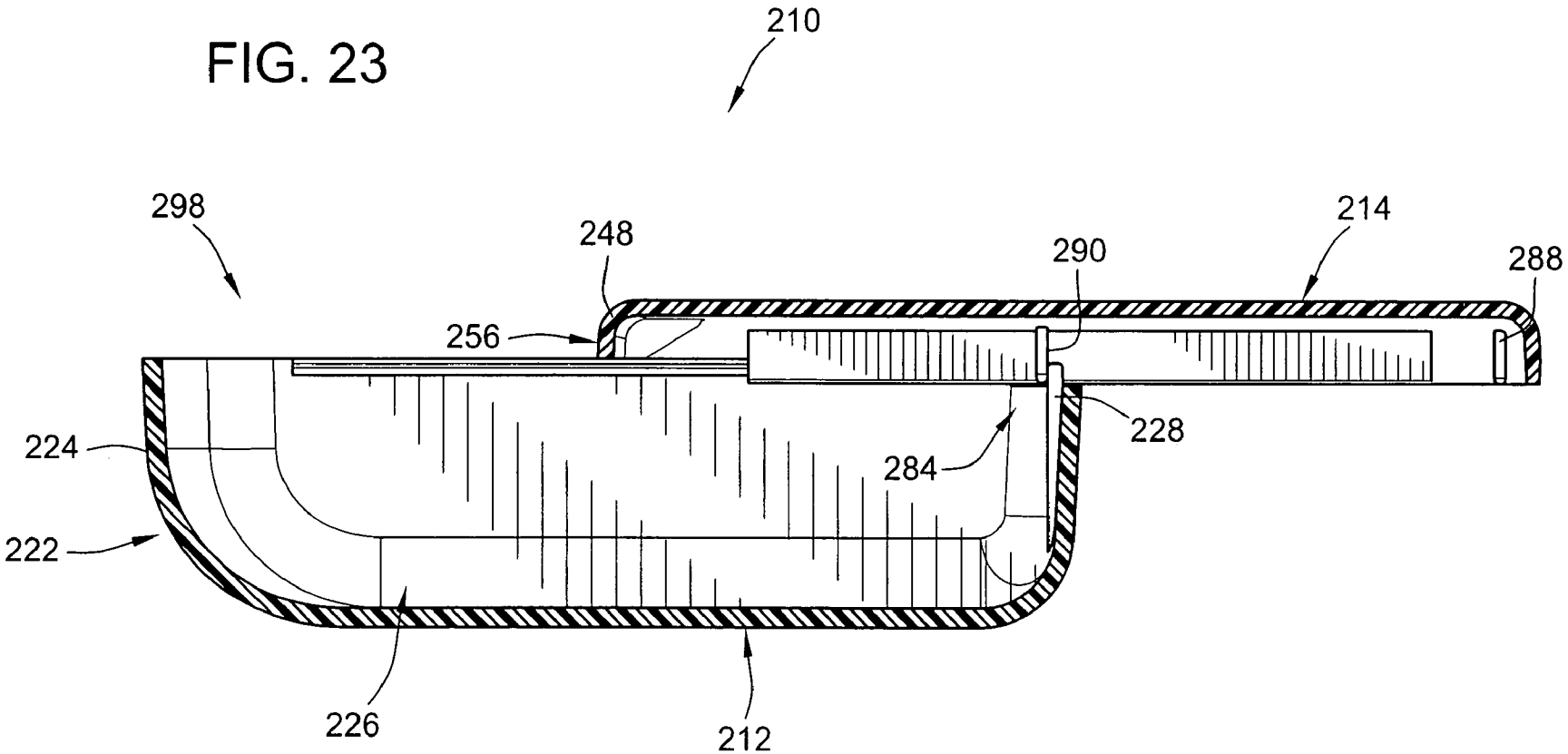
FIG. 23 is a cross-section view of the container of FIG. 19 after the plastic container lid has been slid relative to the plastic container base to place the container in a fully open position.

The pair of second tracks 260 is dimensioned to slideably engage with the pair of first tracks 244 as collectively illustrated in FIGS. 22-23 to form an engagement system 284. The pairs of first and second tracks 244, 260 can be sized such that they provide the container 210 with a friction fit when engaged or, alternatively, can be sized such that they couple in a somewhat more freely and easily slideable arrangement.

Referring specifically to FIG. 22, the container 210 is depicted in a "closed" position. In the closed position, a catch 228 is engaged with a first detent 288. In contrast, in FIG. 23, the container 210 is shown in a "fully open" position. In the fully open position, the catch 228 is engaged with a second detent 290. The second detent 290 preferably prevents the plastic container lid 214 from completely disengaging and separating from the plastic container base 212. In the fully open position, the container 210 forms a dispensing opening 298. The dispensing opening 298 generally permits any products and/or items held in the storage area 226 of the container 10 to be freely dispensed.

All references, including publications, patent applications, and patents cited herein are hereby incorporated by reference to the same extent as if each reference were individually and specifically indicated to be incorporated by reference and were set forth in its entirely herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a plastic container base having a bottom, front and back ends extending upwardly from the bottom in spaced relation, and a pair of sidewalls extending upwardly from the bottom and transversely between the front and back ends to define a storage area;

a plastic container lid slideably disposed on the plastic container base, the plastic container lid including a cover portion that encloses the storage area when the plastic container is in a closed position, and a skirt that depends downwardly from and peripherally around the cover portion, the skirt and the sidewalls of the container base mating at a horizontally extending interface vertically interposed between the bottom and the cover portion, the skirt and the sidewalls each extending horizontally outward to a common outer perimeter extending vertically around the interface such that a perimeter of the container is the same on either side of the interface and is generally smooth along opposing vertically extending sides of the container as a whole;

a pair of first tracks, including one on each of the sidewalls; and a pair of second tracks depending downwardly from opposing sides of the cover portion, the pair of second tracks slideably engaging the pair of first tracks such that the plastic container lid is slideable from the closed position to an open position to form a dispensing opening between the front end of the plastic container base and a forward edge of the cover portion.

2. The container of claim 1, wherein the container includes a catch and at least one detent cooperatively arranged on the container base and the container lid, respectively or vice versa, the catch and the at least one detent being resiliently manipulated when the container is transitioned between the open and closed positions.

3. The container of claim 1, wherein the plastic container base includes a catch in the form of at least one tab projecting upwardly toward the plastic container lid and the plastic container lid includes at least one detent in the form of a web projecting downwardly toward the plastic container base, the web extending transversely away from an interior surface of the cover portion and terminating in a cantilever end, the webs aligned with the at least one tab.

4. The container of claim 3, wherein the catch and the webs are engageable and resiliently disengageable with each other.

5. The container of claim 4, wherein the catch and the detents are engageable and resiliently disengageable with each other as the container is transitioned between the open position and the closed position, and wherein a first one of the at least one detent engages the catch and thereby stops the lid from further translation at the open position and a second one of the at least one detent resiliently snaps past the catch at the closed position.

6. The container of claim 1, wherein each of the pair of first tracks comprises an elongate tongue extending upwardly and inwardly from a terminal edge of each of the pair of sidewalls of the container base.

7. The container of claim 6, wherein each of the pair of second tracks comprises an elongate groove extending generally vertically into a terminal edge of opposing sides of the skirt, the groove slideably engageable with the tongue.

8. The container of claim 1, wherein the pair of first tracks is integrally formed with the plastic container base and the pair of second tracks is integrally formed with the plastic container lid.

9. The container of claim 1, wherein the cover portion includes knurls that form a finger gripping surface.

10. The container of claim 1, wherein the terminal edge of the pair of sidewalls of the plastic container base includes a peripheral base surface and the terminal edge of the skirt of the plastic container lid includes a peripheral cover surface, the peripheral base surface and peripheral cover surface in contact at the interface, and wherein the peripheral cover surface is slideable upon the peripheral base surface when the container transitions between the open and closed positions.

11. The container of claim 1, wherein the forward portion of the cover portion bulges outwardly and curves substantially continuously between opposed sides.

12. The container of claim 1, wherein the pair of first tracks and the pair of second tracks are disposed within the storage area and hidden from view when the container is in the closed position.

13. The container of claim 1 further comprising one or more support ribs disposed on an underside of the cover portion and extending downwardly therefrom, the support ribs inwardly spaced from the skirt and adapted to slideably engage a peripheral surface of the container base as the container transitions between the open and closed position.

14. A container comprising:

a plastic container base having a bottom, front and back ends extending upwardly from the bottom in spaced relation, and a pair of sidewalls extending upwardly from the bottom and transversely between the front and back ends, the front end, back end, and pair of sidewalls extending upward and defining a first terminating edge and to define a storage area;

a plastic container lid slideably disposed on the plastic container base and movable between a closed and an open position, the container lid including a cover portion that encloses the storage area in the closed position and a skirt that depends downwardly from and peripherally around the cover portion to a second terminating edge, the first and second terminating edges mating at a horizontally extending interface, the horizontally extending interface being vertically interposed between the bottom and the cover portion, the container lid forming a dispensing opening when slid from the closed position to the open position; and a stop mechanism comprising cooperating components respectively arranged on the plastic container base and the plastic container lid, the cooperating components including at least one detent and a resilient catch, the at least one detent internally provided under the cover portion, the catch projecting upward past a top surface of the sidewalls of the container base in a cantilever manner.

15. The container of claim 14, wherein a first one of the at least one detent engages the catch and thereby stops the lid from further translation at the open position, and a second one of the at least one detent resiliently snaps past the catch at the closed position.

16. The container of claim 14, wherein the detents are resilient webs.

17. The container of claim 14, wherein the catch comprises a tab or a prong that interferes with the webs as the plastic container lid slides relative to the plastic container base.

18. The container of claim 14, wherein the container further comprises a pair of first tracks, including one of the pair of first tracks extending substantially vertically upward from the first terminating edge of each of the sidewalls of the container base, and a pair of second tracks including one of the pair of second tracks extending substantially vertically inward into the second terminating edge of each opposing sides of the skirt, the pair of second tracks slideably engaging the pair of first tracks at the interface such that the plastic container lid is slideable from the closed position to the open position to form a dispensing opening between the front end of the plastic container base and a forward edge of the cover portion, and wherein a perimeter of the container is the same on either side of the interface and is generally smooth along opposing sides of the container as a whole.

19. The container of claim 14, wherein the cooperating components further include a step formed on the plastic container lid, the step depending downwardly from the skirt, and an abutment surface formed in a terminal end of the sidewalls of the plastic container base, the step and the abutment surface are engaged and the lid is prevented from further translation past the front end of the container base when the container is in the closed position, and disengaged when the container is in the open position.

20. The container of claim 14, wherein the front of the plastic container base is sloped to form a dispensing chute, the dispensing chute angled upwardly toward the dispensing opening.

21. The container of claim 14, wherein the container lid includes a thumb or finger depression proximate a front end, the depression including one or more knurls.

22. The container of claim 14, further comprising one or more support ribs disposed on an underside of the cover portion and extending downwardly therefrom, the ribs adapted to slideably engage a peripheral surface of the container base as the container transitions between the closed and open positions.

23. A container comprising:

a plastic container base having a bottom, front and back ends extending upwardly from the bottom in spaced relation, and a pair of sidewalls extending upwardly from the bottom and transversely between the front and back ends to define a storage area;

a plastic container lid slideably disposed on the plastic container base and movable between closed and open positions, the container lid including a cover portion that encloses the storage area in the closed position, the container lid movable from the closed position to provide a dispensing opening, and a skirt that depends downwardly from and peripherally around the cover portion, wherein the skirt extends vertically downward to a first terminating edge, and the sidewalls extend upward to a second terminating edge; and a tongue and groove locking interface comprising a tongue interfit with a groove, the tongue and groove interface being vertically interposed between the cover portion and the bottom and formed into two opposing sides of the first and second terminating edges, wherein the tongue is slideable within the groove to fully enclose the storage area of the container base with the lid such that the tongue and groove locking interface is hidden from view when the container is in the closed position.

24. The container of claim 23, further comprising a means for stopping the lid in a closed position and an open position, the open position displaced a predetermined distance from the open position to define a dispensing opening of a predetermined size.

25. The container of claim 23, wherein the tongue slideably engages the groove such that the container lid is slidable relative to the container base between the closed and open positions.

26. The container of claim 23, wherein the container is dimensioned to be held within a hand.

27. The container of claim 23 wherein the tongue and groove extend vertically into locking engagement with each other with substantially no under cuts and relative to a vertical axis such that the cover and the base can be formed from a single pull mold along a part line.

28. The container of claim 23 wherein the skirt and the sidewalls of the container base mate at a horizontally extending interface, the skirt and the sidewalls each extending horizontally outward to a common outer perimeter extending vertically around the interface such that a perimeter of the container is the same on either side of the interface and is generally smooth along opposing vertically extending sides of the container as a whole.

29. The container of claim 28, wherein the tongue and groove are engaged proximal to the interface and interior to the outer periphery of the container.

* * * * *